US006047960A

United States Patent [19]

Kawano et al.

[11] Patent Number: 6,047,960

[45] Date of Patent: Apr. 11, 2000

[54] SHEET TAMPING DEVICE FOR OFFSETTING STACKS OF DOCUMENTS

[75] Inventors: Minoru Kawano, Hachioji; Toshitaka Matsumoto, Asaka; Masaru Ohtsuka, Hachioji, all of Japan

[73] Assignee: Konica Corporation, Japan

[21] Appl. No.: 08/840,672

[22] Filed: Apr. 29, 1997

[30] Foreign Application Priority Data

May 7, 1996 [JP] Japan ..... 8-112535
May 24, 1996 [JP] Japan ..... 8-129767

[51] Int. Cl.[7] ..... B65H 29/38

[52] U.S. Cl. ..... 271/184; 271/249; 271/228; 270/58.11; 270/58.13; 414/791.2

[58] Field of Search ..... 271/228, 249, 271/250, 251, 252, 184, 207; 414/791.2; 270/58.08, 58, 58.11, 58.13

[56] References Cited

U.S. PATENT DOCUMENTS 4,480,825 11/1984 Landa ..... 271/207 X
4,712,786 12/1987 Looney ..... 271/207
4,833,989 5/1989 Wieland ..... 271/252 X
4,977,432 12/1990 Coombs et al. ..... 271/184 X
4,986,527 1/1991 Ogoda ..... 271/250
5,088,721 2/1992 Suzuki et al. ..... 271/251 X
5,280,901 1/1994 Smith et al. ..... 271/250 X
5,335,904 8/1994 Ryuzaki ..... 271/250 X
5,362,041 11/1994 Ryuzaki et al. ..... 271/250 X
5,513,839 5/1996 Green ..... 271/207 X
5,540,370 7/1996 Ring ..... 271/250 X

*Primary Examiner*—Christopher P. Ellis
*Assistant Examiner*—Patrick Mackey
*Attorney, Agent, or Firm*—Jordan B. Bierman; Bierman, Muserlian and Lucas

[57] ABSTRACT

A conveyor receives and holds a recorded sheet discharged from an image forming apparatus, the sheet is conveyed along a path and another conveyor is provided along the path at a predetermined distance from the first conveyor to further convey the sheet. There is a shifting device between the two conveyors for holding and individually shifting groups each containing a prescribed number of sheets, perpendicularly to the conveying direction of the sheets. There is a delivery tray for receiving the sheets delivered by the other conveyor.

14 Claims, 28 Drawing Sheets

FIG. 3 ( a )
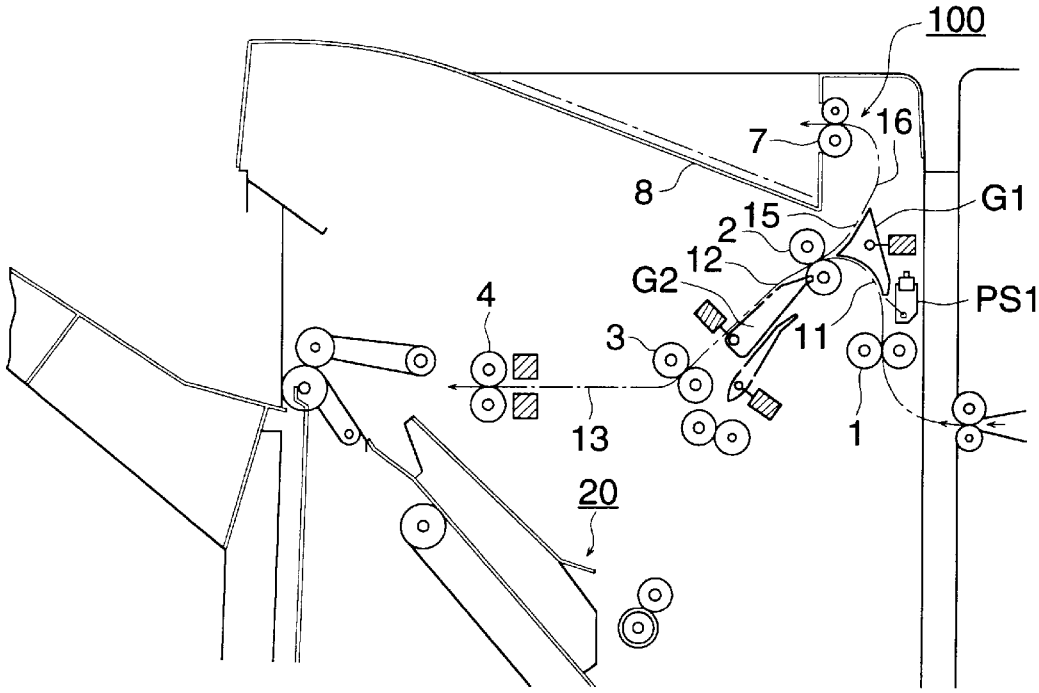
FIG. 3 ( b )
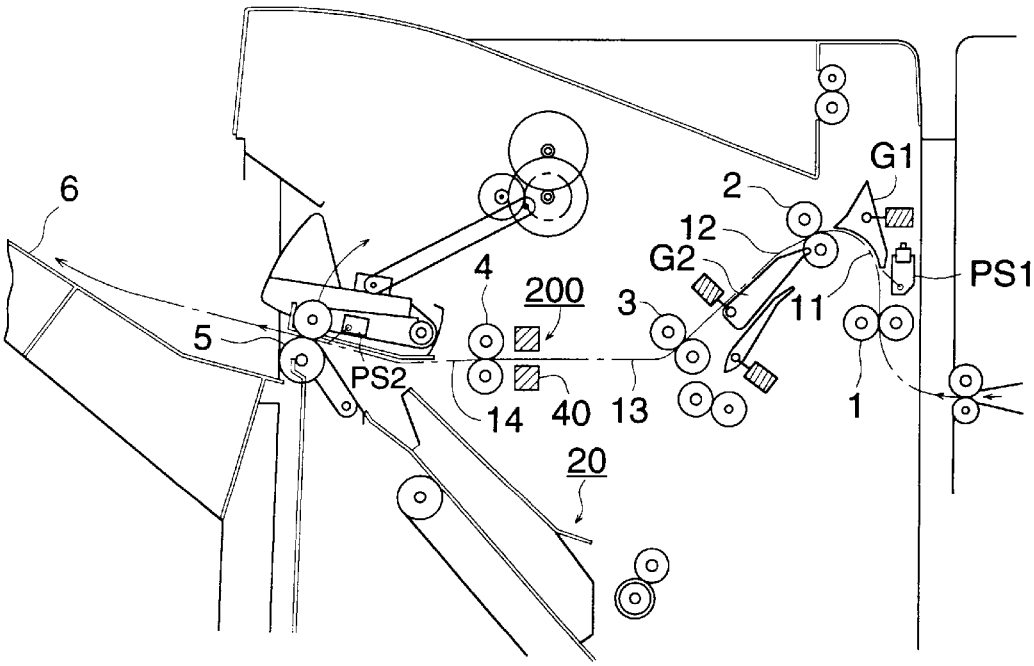

(d)

FIG. 23 ( a )
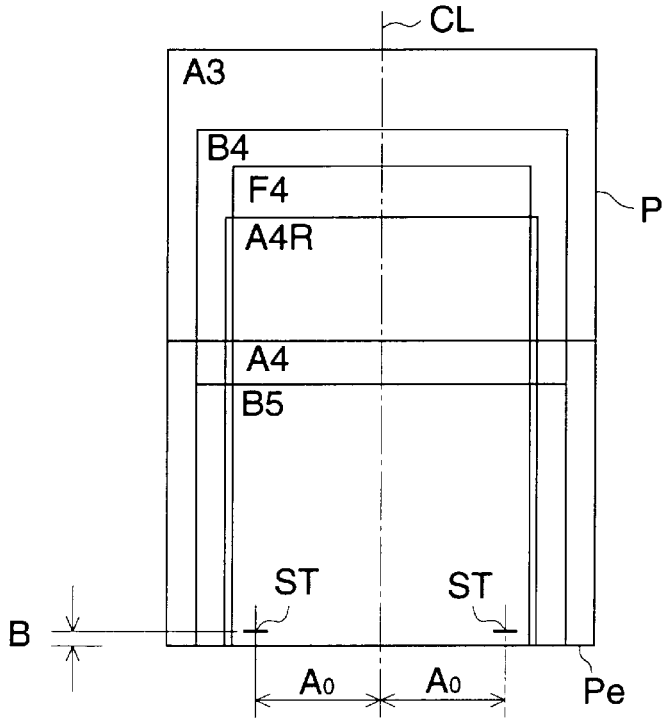
FIG. 23 ( b )
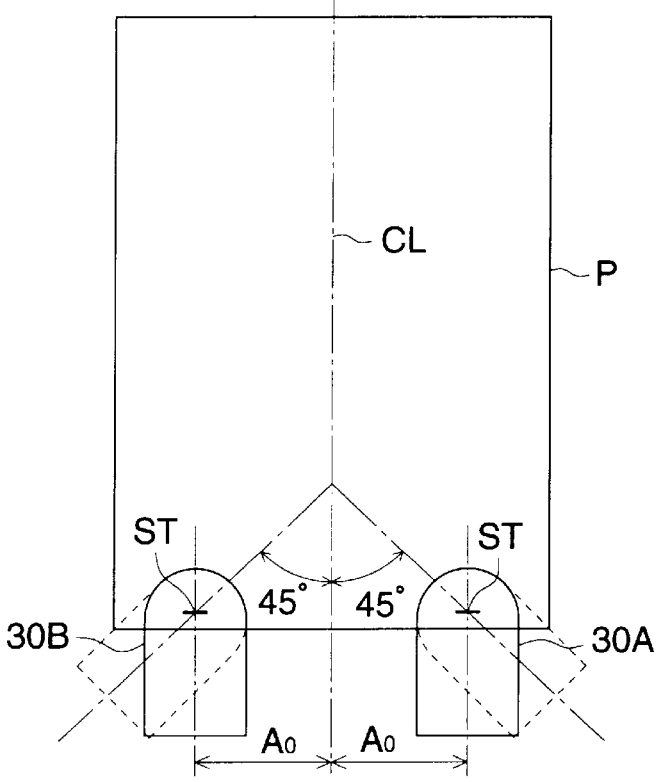

SHEET TAMPING DEVICE FOR OFFSETTING STACKS OF DOCUMENTS

BACKGROUND OF THE INVENTION

The present invention relates to a sheet finishing apparatus in which a plurality of recording sheets, on which images are recorded by a copier, a printer or a similar apparatus, are sorted for each predetermined number of sheets, and are stacked onto a delivery tray.

When a sheet finishing apparatus is provided by which a plurality of copied sheets are automatically sorted for each predetermined number of sheets, it is very convenient for the operator because no additional operation is necessary for sheet finishing, in a case (the sort mode) where plural sets of prints are successively delivered, wherein a single set of prints is formed of a plurality of sheets on which images are recorded by an image forming apparatus such as a copier, a printer or a similar apparatus, or in a case (the group mode) where plural numbers of sheets are successively copied corresponding to the same single document, and plural sets of sheets are copied with respect to a plurality of documents.

Further, as an apparatus to collate a plurality of sheets, which are delivered from the image forming apparatus and on which images have been recorded, for each copied set and to staple it by a stapler, a sheet finishing apparatus, which is called a finisher, is used. Functions of the finisher are connected to those of the image forming apparatus, and the finisher is driven corresponding to the sequence operation of the copy process. In this finisher, there is a finisher, also provided with a sheet sorting means (a shift means) other than a stapler. Sheets, which require no stapling processing, are shifted in the direction perpendicular to the sheet conveyance direction, for each set of copy sheets by the shift means, and are delivered onto the delivery tray.

As a sheet sorting apparatus for this purpose, a sorting tray apparatus is widely known in which a delivery tray can be moved perpendicular to the sheet delivery direction; and a delivery sheet tray is moved every time when a single set of a predetermined number of sheets has been delivered, so that each set of a predetermined number of sheets is alternately stacked on the tray (Japanese Patent Publication Open to Public Inspection No. 217464/1986, and others). In this case, an eccentric cam or similar parts are used for the movement of the delivery sheet tray.

Further, the following sorting tray apparatus is also widely known: the delivery sheet tray is rotated by a predetermined angle in the tray surface plane, so that each set of sheets is alternately stacked while each set of sheets is shifted from each other by a predetermined angle.

Other than the above devices, a sorter is also used in which a plurality of delivery sheet trays (bins) are provided and a delivery sheet tray, opposite to the delivery port, is switched for a predetermined number of sheets.

In each of above apparatus, it is required to move the delivery sheet tray while sheets are stacked on the delivery sheet tray. Accordingly, there are disadvantages in which the apparatus becomes completed; the size of the apparatus is increased; and the power consumption is increased, etc. Especially, when a delivery sheet tray, on which about 2000 sheets can be stacked, is shifted, a large power driving motor is necessary. Further, there are problems in which, when a delivery sheet tray, on which sheets are stacked, is moved perpendicular to the delivery direction, sheets stacked on the delivery sheet tray collapse and become irregular, so that sorting is very difficult, or sheets fall down from the delivery sheet tray.

Still further, a sheet sorting apparatus is widely known in which sheets, delivered from a pair of discharging rollers of the image forming apparatus onto a delivery sheet holder, are respectively shifted from each other for each predetermined number of sheets and stacked on the delivery sheet holder, and sheets are sorted, when a pair of discharging rollers to pressure-contact and hold the sheet are reciprocally moved along the axis by a predetermined distance (Japanese Patent Publication Open to Public Inspection 33459/1986). In this sheet sorting apparatus, there is a problem in which a driving transmission mechanism becomes complicated, because a pair of discharging rollers by which sheets are held during delivering, and which are in pressure-contact with each other and are rotated, are moved along the axis.

Still further, the present invention relates to a sheet finishing apparatus which is provided with a stapling means (a stapler) and by which recording sheets (sheets), on which images are recorded by the image forming apparatus, are automatically finishing-processed and delivered, and specifically relates to a manual operation and automatic position control of the stapling means.

With respect to an image forming apparatus in which copying can be processed at a high speed, a finisher is required which can follow the speed, perform its functions, and conduct high speed processing.

Such a finisher which can conduct high speed processing, has already been disclosed in Japanese Patent Publication Open to Public Inspection Nos. 142359/1985, 158463/1985, 239169/1987, 288002/1987, 267667/1988, 276691/1990, 276692/1990, and Japanese Patent Publication No. 41991/1993.

Sheets, on which images have been recorded and delivered from the image forming apparatus main body, are successively stacked on an intermediate stacker while being aligned. After a single set of sheets has been accommodated in the intermediate stacker, sheet finishing such as stapling, is conducted, and sets of stapled sheets are conveyed by a delivery belt provided in a bottom portion of the intermediate stacker. Further, the sheets are held by a sheet holding and delivery means such as a pair of upper and lower discharging rollers, and delivered onto a delivery sheet tray.

An image forming apparatus provided with a sheet finishing unit, disclosed in Japanese patent Publication Open to Public Inspection No. 277591/1991, has the fist staple mode in which one portion is stapled which is separated from an end of a side of the recording sheet by a predetermined distance along the side, and the second staple mode in which two portions are stapled which are separated from each other along one side of the recording sheet by a predetermined distance, on both sides of the central portion of the side of the recording sheet.

In a conventional sheet finishing apparatus, staple units are fixed on the base frame, and thereby, in staple-processing of sets of sheets, when a failure such as buckling of a staple pin occurs, it is difficult to take out the failed set of sheets or the failed staple pin.

In the conventional sheet finishing apparatus, a staple pin is pinned in parallel to a side of the recording sheet in the first staple mode for one portion stapling and also the second staple mode for two portion stapling, as shown in the above-described Japanese Patent Publication Open to Public Inspection 177591/1991. However, in the first staple mode for one portion stapling, a staple pin is pinned at one portion of a corner of a set of sheets in parallel to a side of the recording sheet. Thereby, when a set of sheets is opened for reading, there is a possibility in which a sheet is broken at a stapled portion. Accordingly, when one portion of a corner of a set of sheets is stapled by a staple means, stapling is preferably conducted diagonally (for example, by 45°) with respect to a width of sheets, for convenience of use for opening a page of sheets. Further, when two portions near the central portion of the width of sheets are stapled, stapling is preferably conducted on two portions parallel to the direction of the width of sheet.

SUMMARY OF THE INVENTION

The first object of the present invention is to remove the above-described conventional drawbacks in a sheet sorting apparatus to sort sheets delivered from an image forming apparatus, and to provide a sheet sorting apparatus which can securely sort the sheets by a simple structure. Further, the object is to provide a sheet sorting apparatus by which a large number of sheets can be sorted and stacked on an elevating delivery sheet tray of the sheet finishing apparatus.

As a result of solutions of the above-described problems and improvement of the apparatus, the second object is to provide a sheet finishing apparatus in which performance for the recovery operation is increased when a failure of the staple means occurs, and by which optimal stapling can be conducted on various sizes of sets of sheets.

In order to attain the first object, the sheet finishing apparatus of the present invention which receives recorded sheets conveyed from a sheet delivery section of an image forming apparatus, conveys the sheets along a sheet conveyance path, shifts every predetermined number of sheets approximately perpendicular to the sheet conveyance direction, and delivers the sheets onto a delivery sheet tray, has a first sheet holding and conveying means and a second sheet holding and conveying means, which are provided with a predetermined interval between them in order to hold and convey the sheets along the sheet conveyance path, and a shifting means which is provided between the first sheet holding and conveying means and the second sheet holding and conveying means, and which holds and shifts the sheets approximately perpendicular to the sheet conveyance direction.

In order to attain the first object, another sheet finishing apparatus of the present invention which receives a recorded sheets conveyed from a sheet delivery section of an image forming apparatus, conveys the sheets along a sheet conveyance path, shifts every predetermined number of sheets approximately perpendicular to the sheet conveyance direction, and delivers the sheets onto a delivery sheet tray, has a first sheet holding and conveying means which holds and conveys the sheet along the sheet conveyance path, the second sheet holding and conveying means which is provided with a predetermined interval from the first sheet holding and conveying means and can release the pressure-contact, a driving means to operate the release of pressure-contact of the first or the second sheet holding and conveying means; a shift means provided between the first and the second sheet holding and conveying means, and holds and shifts the sheets perpendicular to the sheet conveyance direction, a driving means to operate sheet holding and sheet shifting of the shift means, a sheet passage sensor to detect the end portion of the sheet, passing along the sheet conveyance path, and a control means to control the driving means of the first or the second sheet holding and conveying means, and the driving means for the shift means, by a detection signal of the sheet passage sensor.

In order to attain the first object, still another sheet finishing apparatus of the present invention, which receives recorded sheets conveyed from a sheet delivery section of an image forming apparatus, conveys the sheet along a sheet conveyance path, shifts the sheets at every predetermined number approximately perpendicular to the sheet conveyance direction, and delivers the sheets onto a delivery sheet tray, has a sheet holding and conveying means to hold and convey the sheets along the sheet conveyance path, a low speed sheet delivery means which is provided nearer the sheet delivery exit located on the downstream side of the sheet conveyance direction, with respect to the sheet holding and conveying means, and which delivers the sheets onto the delivery sheet tray at a lower conveyance speed than the sheet conveyance speed by the sheet holding and conveying means, wherein the low speed sheet delivery means shifts the sheets onto the delivery sheet tray by shifting the sheets at every predetermined number approximately perpendicular to the sheet conveyance direction during the sheet delivery operation.

In order to attain the second object, a sheet finishing apparatus of the present invention in which sheets delivered from an image forming apparatus are conveyed and stacked onto an intermediate stacker, aligned by an alignment means, and an end portion of the sheets is stapled by a staple means, the sheet finishing apparatus has a supporting base to support the staple means; an oscillating means to support the supporting base so that it can be oscillated with respect to the intermediate stacker; and a holding means to hold the oscillating means so that it can be engaged and disengaged, wherein engagement by the holding means is released so that the supporting base is oscillated by the oscillating means, and a sheet end stacking portion of the intermediate stacker can be opened.

In order to attain the second object, another sheet finishing apparatus of the present invention in which sheets delivered from an image forming apparatus are conveyed and stacked onto an intermediate stacker, contact a sheet end contact stopper, aligned by an alignment means, and an end portion of the sheets is stapled by a staple means, the sheet finishing apparatus has a movable base plate on which the staple means is mounted, and which can move parallel to the sheet end contact stopper surface, a linear movement means to move the movable base plate parallel to the sheet end contact stopper surface, a rotation means to rotate the staple means by a predetermined angle with respect to the stopper surface, and a control means to control the linear movement means and the rotation means so as to move the staple means to a selected position and angle.

In order to attain the second object, in still another sheet finishing apparatus of the present invention in which sheets delivered from an image forming apparatus are conveyed and stacked onto an intermediate stacker, aligned by an alignment means, and an end portion of the sheets is stapled by a staple means, when the sheet end portion is stapled by the staple means, in a one-portion stapling mode, one stapling operation is conducted diagonally at a corner of the sheet end portion, and in a two-portion stapling mode, two stapling operations are conducted at positions parallel to the sheet width direction of the sheet end.

BRIEF DESCRIPTION OF THE DRAWINGS

FIG. 3(*a*) is an illustration showing a sheet conveyance path in the first conveyance path.

FIG. 3(*b*) is an illustration showing a conveyance path in the second conveyance path.

FIG. 4(*b*) is an illustration showing a conveyance path in the fourth conveyance path.

FIG. 7(*b*) is a sectional side view of the shift means.

FIG. 23(*a*) is a plan view showing a condition in which two portions of various sized sheets are stapled.

FIG. 23(*b*) is a plan view showing an arrangement of the staple unit by which two portions are stapled.

DETAILED DESCRIPTION OF THE PREFERRED EMBODIMENT

Referring to the attached drawings, an example of a sheet finishing apparatus of the present invention will be described below.

Figure 1:
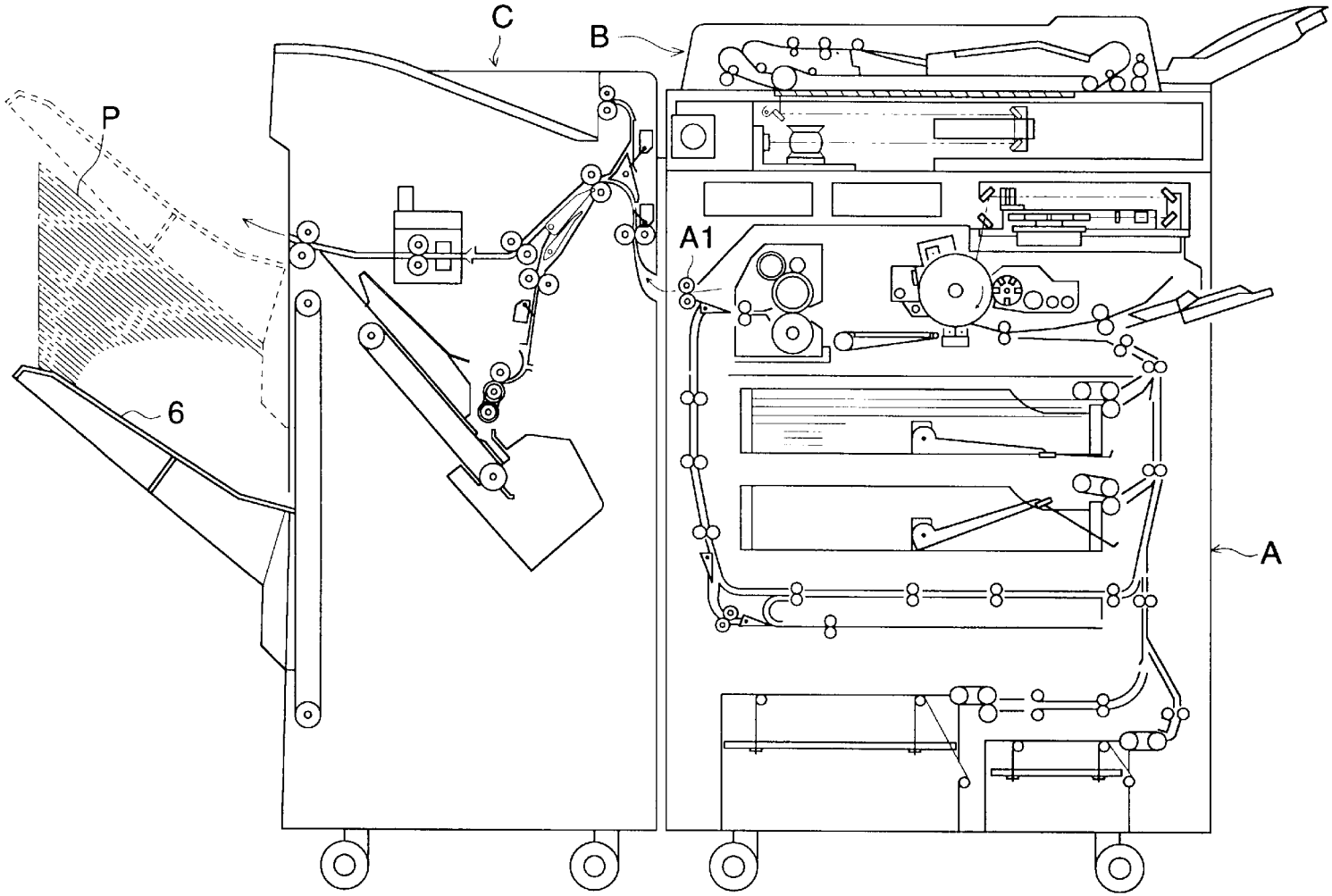
FIG. 1 is a view showing the structure of a sheet finishing apparatus connected to an image forming apparatus.

FIG. 1 is a view showing the structure of a sheet finishing apparatus connected to an image forming apparatus. In FIG. 1, an image forming apparatus A comprises a document image reading section composed of an exposure scanning optical system, an image writing section composed of a laser beam scanning optical system, an image forming section composed of a charging, developing, transferring, separation, fixing, and cleaning means, a sheet feeding means, an automatic duplex unit (ADU), a conveyance means, and a sheet delivery means. An automatic document feeder (ADF) B is mounted above the image forming apparatus A such that it can be opened and closed.

A sheet P sent from the sheet feeding means is image-formed by the image forming section, delivered outside the image forming apparatus main body from a pair of discharging rollers A1 located at the most downstream portion of the conveyance means, and conveyed into a sheet finisher C, which will be described later. The sheet, conveyed from a pair of discharging rollers A1 of the image forming apparatus A into the sheet finisher C, is delivered outside the apparatus after sheet finishing such as stapling, or sheet sorting, and is stacked onto a delivery sheet tray 6 which can be elevated. A large number of sheets can be stacked on the delivery sheet tray 6 (for example, 1500 A3-sized sheets, or 2000 B4-sized sheets).

Figure 2:
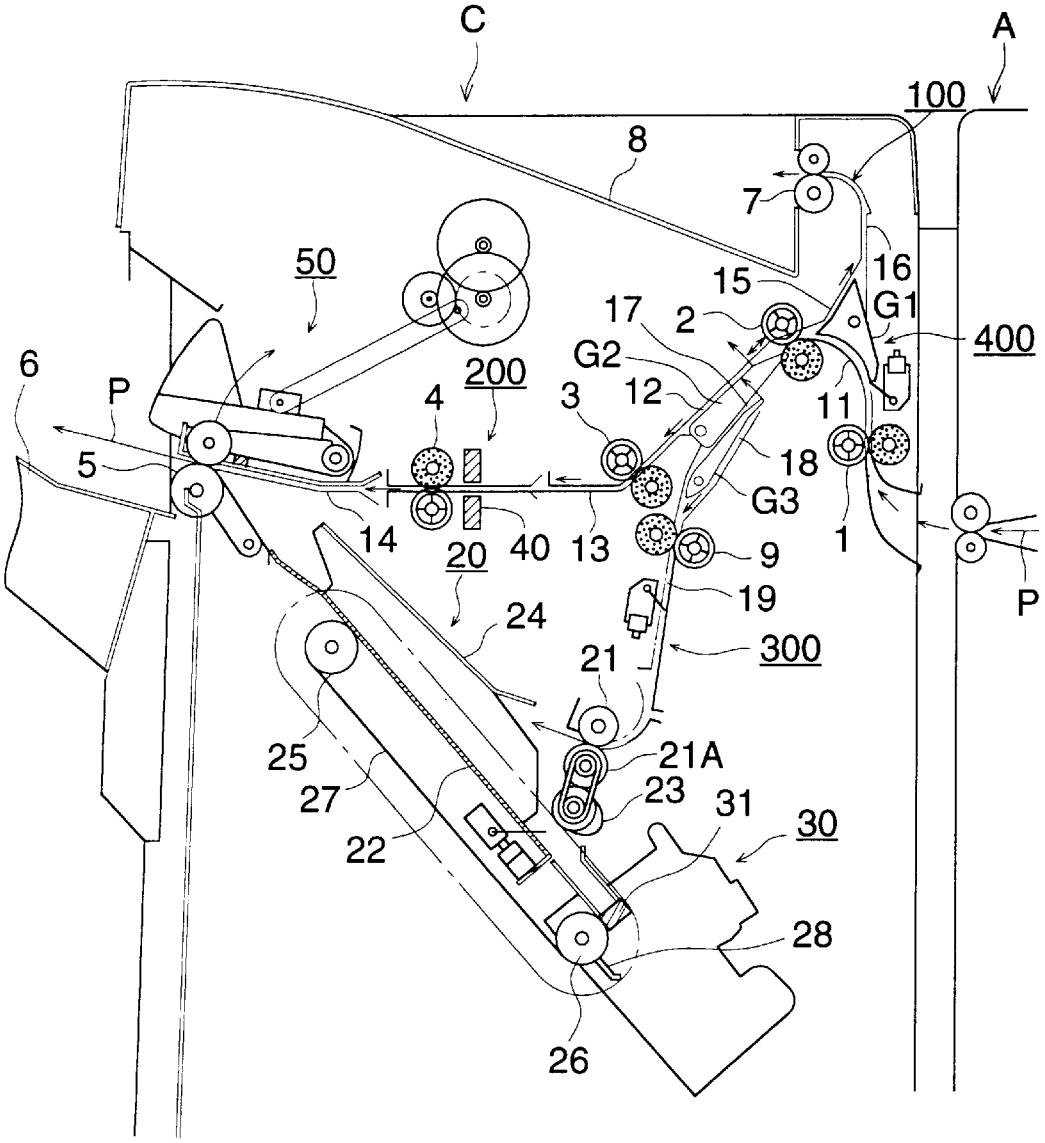
FIG. 2 is a sectional view showing the structure of the sheet finishing apparatus.

FIG. 2 is a sectional view showing the structure of the sheet finisher C. The sheet finisher C is arranged such that the height of an opening of a receiving portion for the sheet P coincides with the height of a sheet delivery port of the pair of discharging rollers A1 of the image forming apparatus (a copier, a printer, etc.), and is connected to a control system so that a sheet conveyance portion is driven in the sheet finisher, corresponding to the operation of the image forming apparatus main body.

Figure 4:
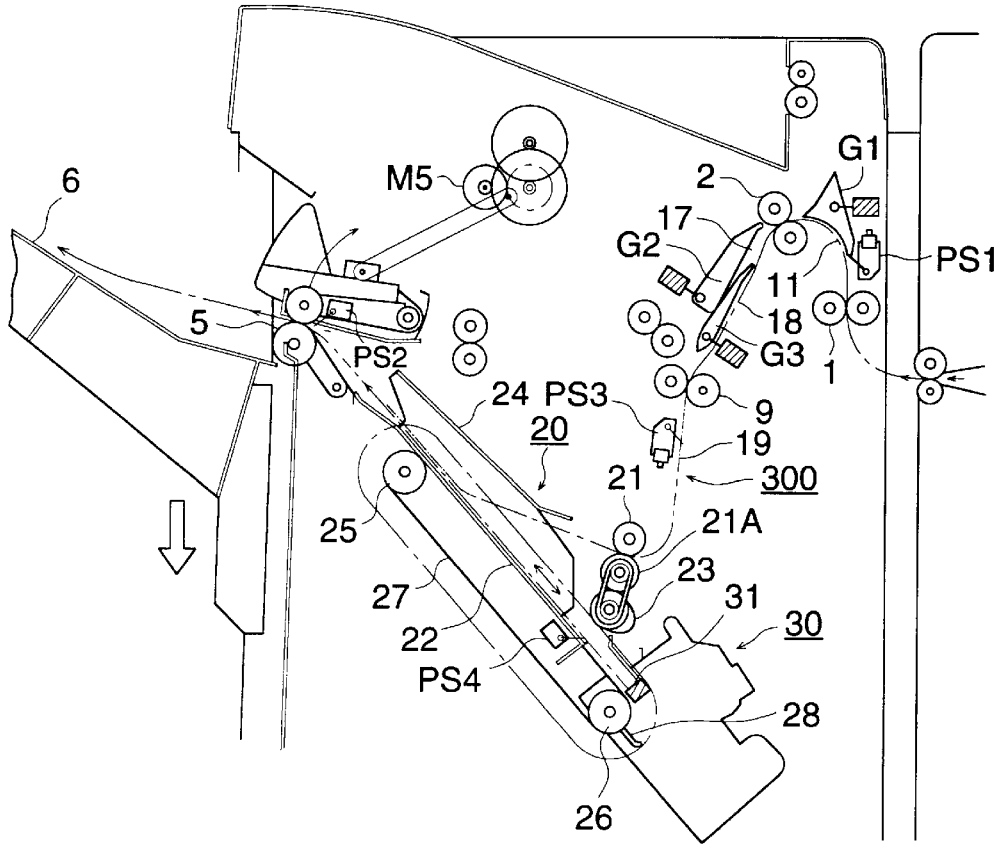
FIG. 4(*a*) is an illustration showing a conveyance path in the third conveyance path.
Figure 4:
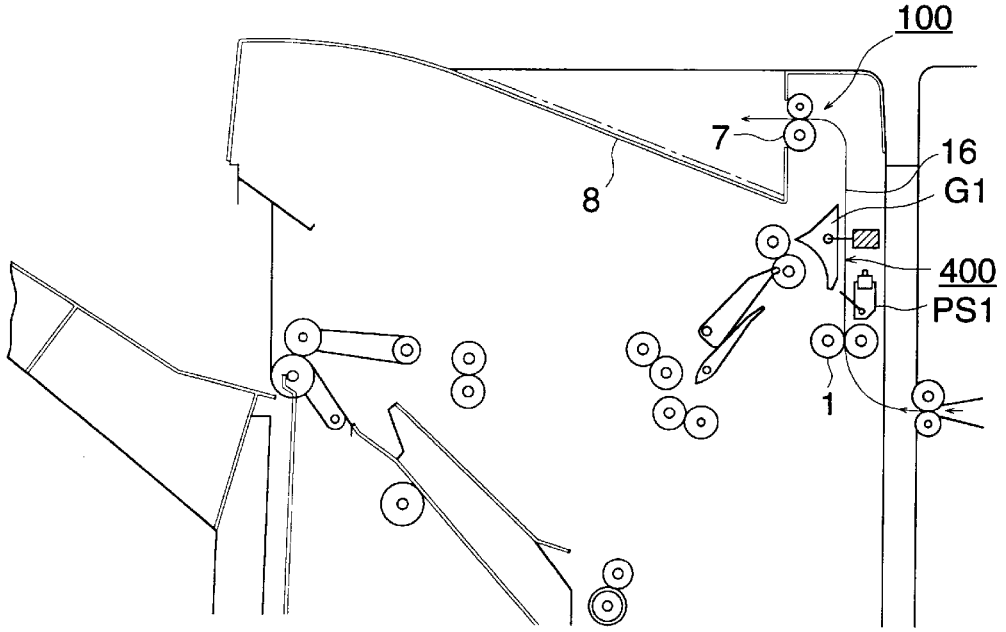

A conveyance path of the sheet P, connected to a downstream portion of a pair of rollers 1 of an entry portion of the receiving portion, is branched into 4 systems of the first conveyance path 100 located at the upper portion, the second conveyance path 200 located at the middle portion, the third conveyance path 300 located at the lower portion, and the fourth conveyance path 400 to directly convey the sheet from the pair of rollers 1 of the entry portion to the second delivery sheet tray 8 located at the upper portion. The sheet P is fed onto any of the conveyance paths by selecting angles of switching gates G1, G2, and G3. Referring to FIGS. 3 and 4, the structure of each conveyance path will be described below.

FIG. 3(*a*) is an illustration showing the conveyance path of the sheet P in the first conveyance path 100 (one-dotted chain line). FIG. 3(*b*) is an illustration showing the conveyance path of the sheet P in the second conveyance path 200 (one-dotted chain line). FIG. 4(*a*) is an illustration showing the conveyance path of the sheet P in the third conveyance path 300 (one-dotted chain line). FIG. 4(*b*) is an illustration showing the conveyance path of the sheet P in the fourth conveyance path 400 (one-dotted chain line).

(1) The first conveyance path 100 (the printer mode, sheet delivery with the image surface facing downward)

In FIG. 3(*a*), the sheet P, delivered with its image surface facing upward from the image forming apparatus main body, is conveyed by the pair of rollers 1 of the entry portion; passes a path 11 located below the first upper switching gate G1; held by a pair of conveyance rollers 2 and passes a path 12 located above the second switching gate G2 which is provided at a diagonally lower portion, which is the second conveyance path 200; and passes through a pair of conveyance rollers 3, a path 13, a pair of conveyance rollers 4. After the sheet P temporarily stops, the conveyance direction of the sheet P is switched back by the pair of conveyance rollers 2, 3 and 4, rotation of which is reversed; the sheet P passes a path 15 located above the first switching gate G1, and a path 16 above the path 15; and is delivered onto a delivery sheet tray 8 located at the upper portion outside the apparatus by a pair of discharging rollers 7 with the image surface facing downward (face down), and placed thereon in the order of pages.

(2) The second conveyance path 200 (a copy mode, the sheet delivery with the image surface facing upward, a non-staple mode including the offset sheet delivery)

In FIG. 3(*b*), the sheet P delivered from the image forming apparatus main body with the image surface facing upward (face up), is conveyed by the pair of rollers 1 of the entry portion, passes the path 11 below the first switching gate G1 located at the upper portion, held by the pair of conveyance rollers 2, passes the path 12, which is the second conveyance path 200, above the second switching gate G2 located at the diagonally lower portion, and is delivered and placed on the delivery sheet tray 6 outside the apparatus by the pair of discharging rollers 5 with the image surface facing upward, through the pair of conveyance rollers 3 (the first holding and conveying means), the path 13, a shift means 40, the pair of conveyance rollers 4 (the second holding and conveying means), and the path 14. Incidentally, in the automatic document feeder (ADF) connected to the image forming apparatus, the final document is initially exposure processed, and copied sheets are successively sent to the sheet finisher from a copy of the final page, which has been image-forming processed, and are stacked on the delivery sheet tray 6 in the order of pages with the image surface facing upward.

(3) The third conveyance path 300 (a copy mode, the sheet delivery with the image surface facing upward, a staple mode)

In FIG. 4(*a*), sheets P are delivered sequentially from a copy of the final page, which has been image-forming processed in the image forming apparatus main body, with the image surface facing upward (face up), and are successively sent to the sheet finisher. The sheet P sent to the sheet finisher, is conveyed by the pair of rollers 1 of the entry portion, passes the path 11 below the first switching gate G1 located at the upper portion, held by the pair of conveyance rollers 2, passes a path 18, which is the third conveyance path 300, below the third switching gate G3 located diagonally below, and sent to a staple processing section 20 through a pair of conveyance rollers 9 and a path 19.

The sheet P, held and conveyed by the pair of conveyance rollers 21 located at the downstream portion of the path 19, is delivered to an upper space of an inclined intermediate stacker 22, and contacts with the upper surface of the intermediate stacker 22 or the upper surface of the sheet P stacked on the upper surface of the intermediate stacker 22, and further slides upward. After the trailing edge of the sheet P has been delivered from a pair of conveyance rollers 21, the sheet P is lowered by its own weight, slides down on the inclined surface of the intermediate stacker 22, contacts with a sheet stopper surface 31 (a stopper means) near a stapler 30 (a staple means), and stops. A conveyance auxiliary rotation member 23 (a winding member), which is rotated by a belt wound around a pulley which is rotated coaxially with a lower roller 21A of the pair of conveyance rollers 21, slide-contacts with the upper surface of the sliding-down sheet P. Thereby, when the conveyance direction of the sheet P is switched back, the sheet P is assuredly in contact with the stopper member 31 by a sliding-contact action of the conveyance auxiliary rotation member 23.

Numeral 24 is a pair of alignment members provided on the both side surfaces of the intermediate stacker 22 such that the pair of alignment members can be moved. The alignment members 24 can be moved in the direction perpendicular to the sheet conveyance direction. In the case of sheet receiving, in which the sheet P is delivered onto the intermediate stacker 22, the alignment members 24 are widely spread more than the sheet width. When the sheet P slides down on the intermediate stacker 22, contacts with the stopper member 31, and stops, the alignment members 24 lightly knock side ends in the direction of the sheet width, so that the set of sheets is aligned in the direction of sheet width (alignment). In this stop position, when a predetermined number of sheets P are stacked on the intermediate stacker 22 and aligned, stapling is conducted by the stapler 30, and the set of sheets is stapled.

A cutout portion is formed on one portion of the sheet stacking surface of the intermediate stacker 22, and a plurality of delivery belts 27, wound around a drive pulley 25 and a driven pulley 26, are rotatably driven. A delivery claw 28 is integrally formed on one portion of the delivery belts 27, and the top of the claw forms an elliptical track as shown by one-dotted chain line in the drawing. The trailing edge of the stapled set of sheets P is held by the delivery claw 28 of the delivery belts 27. The set of the sheets is moved onto the delivery belts 27, slides on the stacking surface of the intermediate stacker 22, is pushed diagonally upward, and advances to a nip position of the pair of delivery rollers 5. The set of sheets P, nipped by the pair of rotating delivery rollers 5, is delivered onto the delivery tray 6 with the image surface facing upward, and stacked thereon.

(4) The fourth conveyance path 400 (a copy mode, sheet delivery with its image surface facing upward)

In FIG. 4(*b*), the sheet P, delivered from the image forming apparatus main body with the image surface facing upward, is conveyed by the pair of rollers 1 of the entry portion, conveyed upward almost vertically, passes a path 400 (the fourth conveyance path) located in the rear of the switching gate G1, further passes through the upper path 16, and delivered onto the delivery sheet tray 8 with the image surface facing upward (face up) by the pair of discharging rollers 7.

Figure 5:
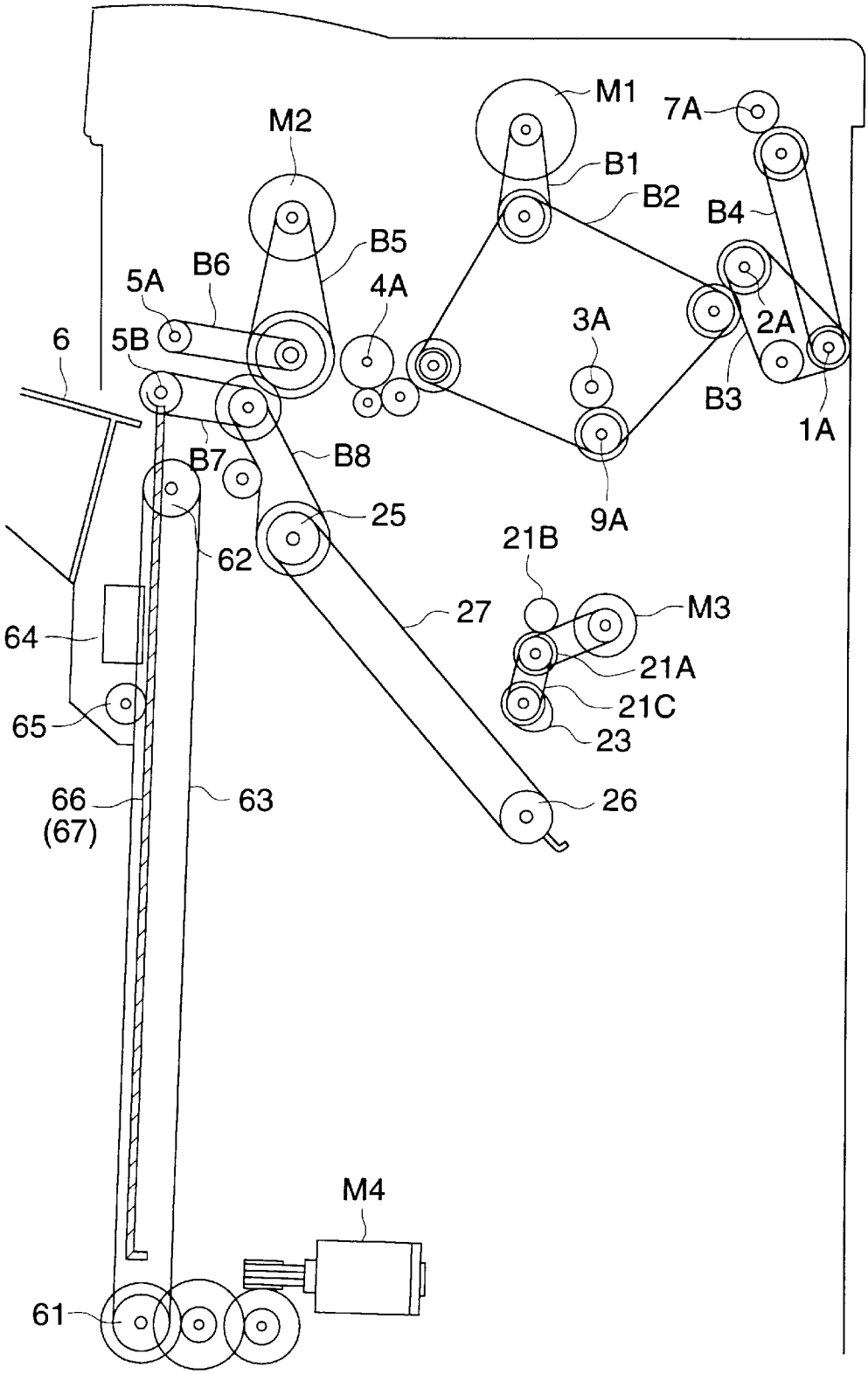
FIG. 5 is a structural view showing a driving system of the sheet finishing apparatus.

FIG. 5 is a view showing the structure of the driving system of the sheet finisher. A motor M1 rotates a driving roller 9A (the left roller) of the pair of conveyance rollers 9 of the third conveyance path 300 via timing belts B1 and B2; and rotates the driving roller 2A (the lower roller) of the pair of conveyance rollers 2 of the second conveyance path 200, the driving roller 3A (the lower roller) of the pair of conveyance rollers 3 (the first holding and conveying means, the first pair of conveyance rollers), and the driving roller 4A (the upper roller) of the pair of conveyance rollers 4 via a gear train. The motor M1 further rotates the driving roller 1A (the right roller) of the pair of receiving rollers 1 through the timing belt B3, and further rotates the driving roller 7A (the lower roller) of the pair of discharging rollers 7 through the timing belt B4.

A motor M2 rotates the upper driving roller 5A (hereinafter, referred to as the upper roller) of the pair of discharging rollers 5 via timing belts B5 and B6, and also rotates the lower driving roller 5B (hereinafter, referred to as the lower roller) of the pair of discharging rollers 5 via the gear train and the timing belt B7. Further, a pulley to drive the lower roller 5B, rotates the driving pulley 25 via the timing belt B8, and rotates the delivery belt 27.

A motor M3 rotates a pair of conveyance rollers 21, composed of a driving roller 21A and a driven roller 21B of the entry portion of the intermediate stacker, and further rotates a conveyance auxiliary rotation member 23 via a belt 21C.

A motor M4 rotates a driving pulley 61 via a gear train, and rotates a wire 63, wound around the driving pulley 61 and a driven pulley 62 located above the driving pulley 61. A base portion of the delivery sheet tray 6 is fixed on one portion of the wire by a clamping member 64. A roller 65, rotatably supported by the base portion of the delivery sheet tray 6, slides on a rail member 66, and when the wire 63 is rotated, the delivery sheet tray 6 can be elevated up or down along the rail member 66.

Figure 6:
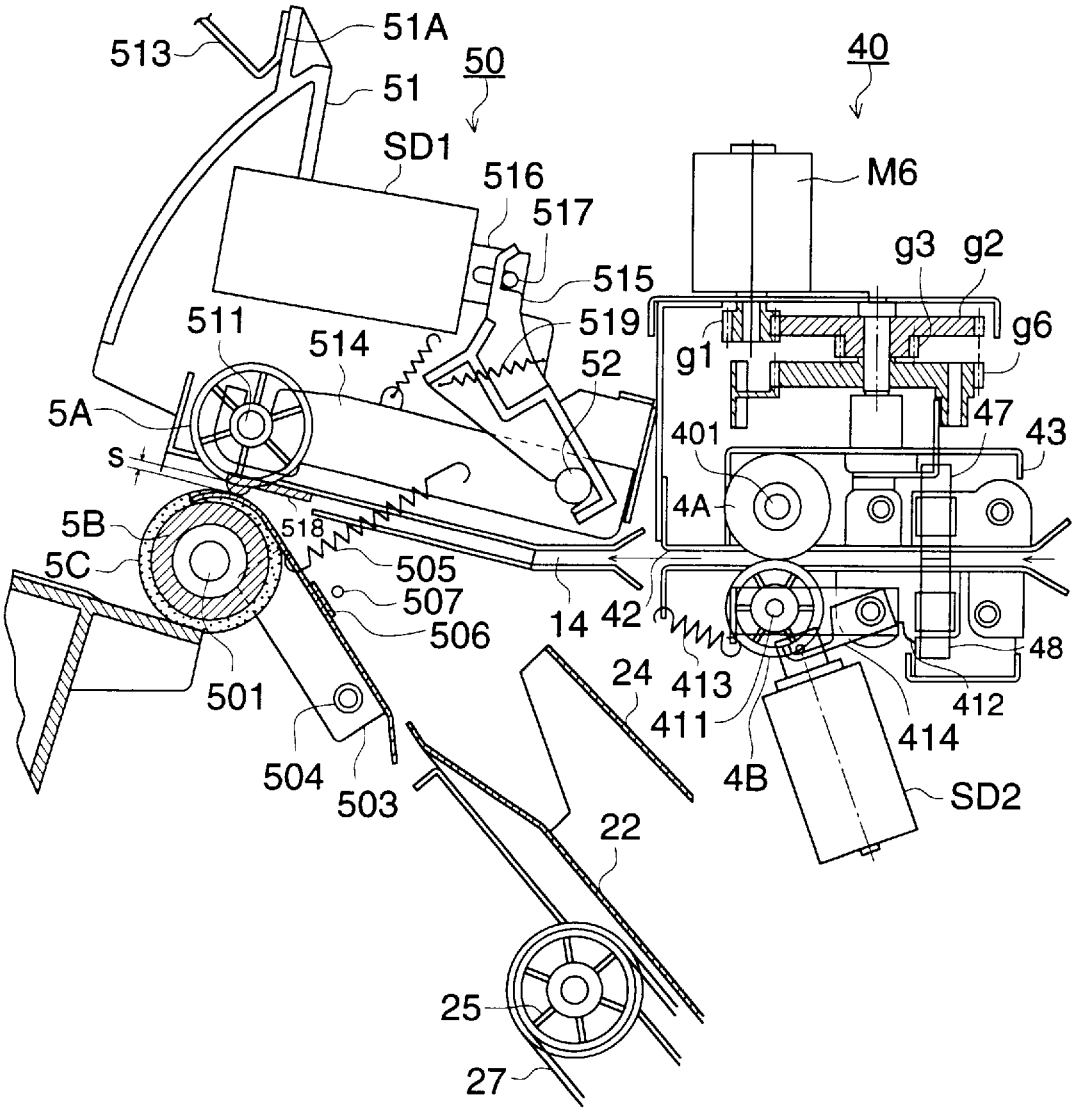
FIG. 6 is a sectional view of a shift means and a sheet delivery means.

FIG. 6 is a sectional view of a shift means 40 and a sheet delivery means 50.

A pair of discharging rollers 5 of the sheet delivery means 50, is composed of an upper roller 5A and a lower roller 5B, which are respectively connected to the motor M2 shown in FIG. 5, and are rotated. The lower roller 5B is rotated at a predetermined position. The rotatable upper roller 5A is supported by a holding member 51, and can be oscillated around the shaft 52. While this upper roller 5A is opened, the delivery path is opened, and a large sized sheet is conveyed from a roller 21 of the entry portion of the intermediate stacker onto the intermediate stacker 22, aligned and stacked thereon.

The sheet delivery means 50 shown in FIG. 6 is composed of an upper unit of the discharging roller, composed of the upper roller 5A, and the lower 5B and a sponge roller 5C. In FIG. 6, a lower unit of the discharging roller is ready for the next operation.

The lower roller unit is composed of a rotation shaft 501 which is rotatably supported by both side walls of the sheet finisher main body and is connected to the motor M2, serving as a drive source, via the belts B7 and B5, a plurality of lower rollers 5B having a rubber layer on their peripheral surfaces, and a plurality of sponge rollers 5C having a soft elastic member layer on their peripheral surfaces.

A delivery sheet guide plate 503 is supported at an intermediate portion of the plurality of lower rollers 5B and the plurality of sponge rollers 5*c* such that the delivery sheet guide plate 503 can be oscillated around a shaft 504. The delivery sheet guide plate 503 is pulled upward by a coil spring 505 (a spring member), stretched between the upper units of the discharging rollers, which will be described later, and contacts with a stopper 507 through a buffer material 506. At the time of contact, the upper surface of the delivery sheet guide 503 is protruded upward from the outer peripheral surface of the sponge roller 5C.

The upper unit of the discharging rollers is composed of a rotation shaft 511, which is rotatably supported by both side walls of the upper unit of the discharging rollers, and is connected to the motor M2, serving as a driving source, through the belts B6 and B5, and a plurality of upper rollers 5A.

A holding member 51 of the upper unit of the discharging rollers can be oscillated around a shaft 52, and when an upper portion of a cover 51A contacts with a stopper 513 of the sheet finisher main body, the oscillation is stopped. An arm member 514 to rotatably support both shaft ends of the rotation shaft 511 of the upper unit of the discharging rollers, and a lever member 515 which is engaged with a pin 517 studded on a plunger 516 of a solenoid SD1, are fixed on the shaft 52, and these members can be integrally oscillated. The solenoid SD1 drives a pressure-contact operation and a release operation of the upper roller 5A with respect to the lower roller 5B. A stopper member 518 is provided outside a sheet passage area at a bottom portion of the arm member 514. The top of the stopper member 518 is set so that an interval "s" is maintained between the peripheral surface of the upper roller 5A and that of the delivery sheet guide plate 503. The sheet P, nipped by the pair of conveyance rollers 4, can smoothly pass between the upper roller 5A and the lower roller 5B, between which the interval "s" is maintained, without contacting with the sponge roller 5C.

The shift means 40 is composed of the pair of conveyance rollers (the second holding and conveying means, the second pair of conveyance rollers) 4, which is composed of the driving roller (the upper conveyance roller) 4A connected to a driving source, and the driven roller (the lower conveyance roller) 4B which is pressure-contacted with the peripheral surface of the driving roller 4A and is driven, and shift levers (grippers) 47 and 48 which hold the sheet P and shift it in the direction perpendicular to the sheet conveyance direction. Both ends of the rotation shaft 401 of the driving roller 4A are rotatably supported by a fixed frame 42 of the shift means 40, and are connected to the motor M1, serving as a driving source, through the belts B2 and B1.

The rotation shaft 411 of the driven roller 4B is rotatably supported by a movable supporting plate 412 which can be oscillated. The movable supporting plate 412 can be integrally oscillated with a lever member 414, which is oscillated by a pin studded on a plunger of a solenoid SD2, and is forced by a coil spring 413. When a voltage is applied onto the solenoid SD2, the lever member 414 and the movable supporting plate 412 are oscillated against the spring force of the coil spring 413 by an attractive operation of the plunger, the driven roller 4B which is in pressure-contact with the driving roller 4A, is separated from the driving roller 4A, and a predetermined gap is formed on the sheet conveyance path. When voltage application is released, the driven roller 4B is in pressure-contact with the driving roller 4A by the spring force of the coil spring 413.

Figure 7:
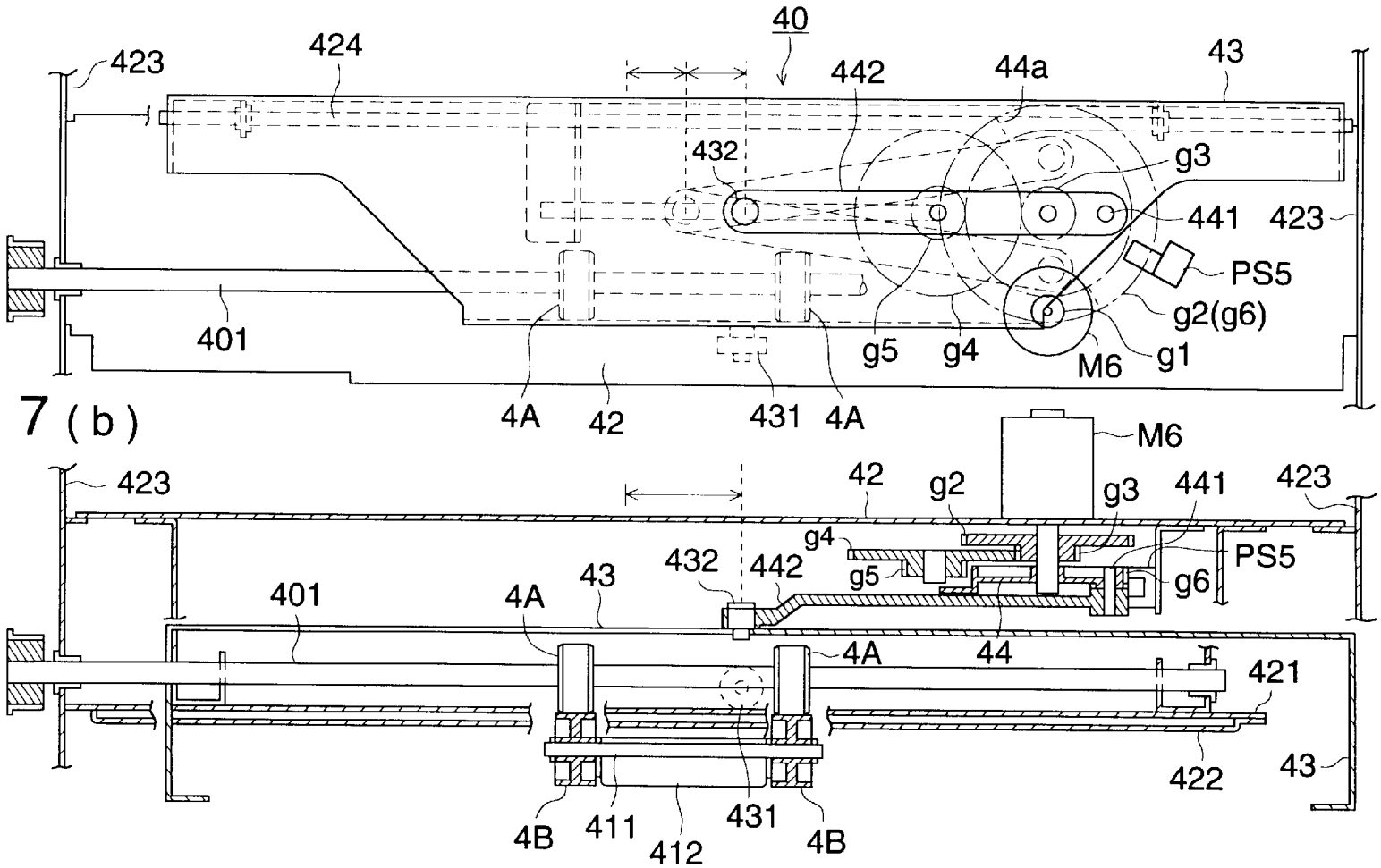
FIG. 7(*a*) is a plan view of the shift means.

FIG. 7(*a*) is a plan view of the shift means 40, and FIG. 7(*b*) is a sectional side view of the shift means 40.

The fixed frame 42 of the shift means is integrally structured with an upper guide plate 421, a lower guide plate 422, which form the path 13 on which the sheet P passes, and both side plates 423. The driving roller 4A, driven roller 4B and a movable frame 43 which supports the gripper 41 to be movable, are supported by the fixed frame 42.

The movable frame 43 is supported by a guide rail 424, horizontally provided on the fixed frame 42, so as to be slidable, and when a roller member 431, supported by one end of the movable frame 43, rolls on the surface of the fixed frame 42, the movable frame 43 can be linearly moved reciprocally in the direction perpendicular to the sheet conveyance direction.

The motor M6 for driving the shift operation, which is fixed on the upper surface of the fixed frame 42, rotates an eccentric disk 44 through a reduction gear train g1–g6. By the eccentrical circular movement of a pin, studded on the movable frame 43, a crank arm 442 is oscillated, and the movable frame 43 is linearly moved reciprocally in the direction perpendicular to the sheet conveyance direction together with a shaft 432, studded on the movable frame 43. A home position sensor PS5 fixed on the fixed frame 42, detects a cutout portion 44*a* provided on the eccentric disk 44, and sets an initial position of the movable frame 43.

Figure 8:
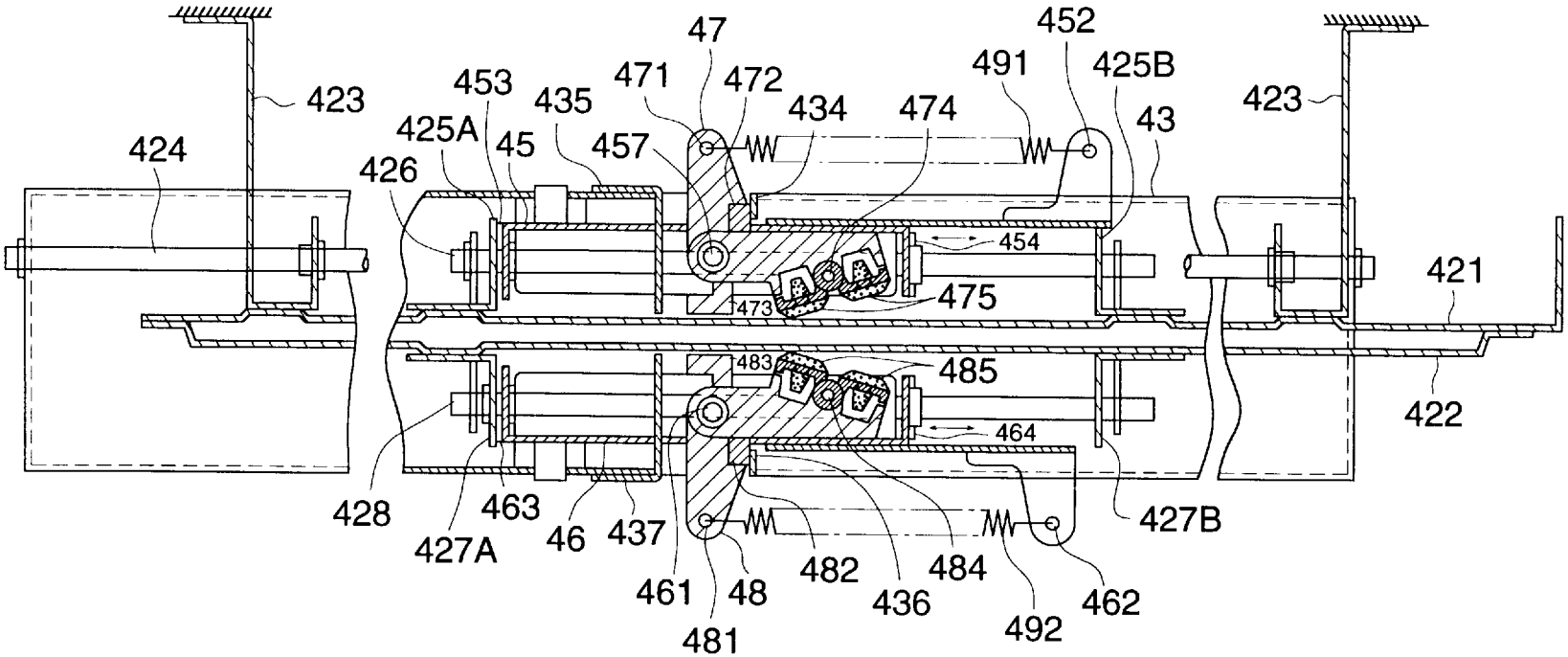
FIG. 8 is a sectional side view of the shift means.

FIG. 8 is a sectional side view of the shift means 40.

Two screen-like supporting members 425 are fixed or the upper surface of the upper guide plate 421. Two guide bars 426 are provided in parallel and fixed between the two supporting members 425. A movable holding member 45 slides on the guide bar 426, and is freely moved in the direction perpendicular to the sheet conveyance direction. In the same manner, two screen-like supporting members 427 are fixed on the lower surface of the lower guide plate 422, and two guide bars 428 are provided in parallel and fixed between the two supporting members 427. A movable holding member 46 slides on the guide bar 428, and is freely moved in the direction perpendicular to the sheet conveyance direction.

An upper shift lever (gripper) 47 is supported on a shaft 451 studded on the movable holding member 45 so that the upper shift lever 47 can be oscillated. A coil spring 491 is stretched between a hole 471 of the leading edge portion of the shift lever 47 and a hole 452 provided on a right upper end portion of the movable holding member 45. Buffer members 453 and 454 are fixed on both side ends of the movable holding member 45.

In the same manner, the lower shift lever (gripper) 48 is supported on a shaft 461 studded on the movable holding member 46 so that the lower shift lever 48 can be oscillated. A coil spring 492 is stretched between a hole 481 of the leading edge portion of the shift lever 48 and a hole 462 provided on a right lower end portion of the movable holding member 46. Incidentally, the spring tension (pulling force) F2 of the coil spring 492 is set smaller than the spring tension (pulling force) F1 of the coil spring 491. Buffer members 463 and 464 are fixed on both side ends of the movable holding member 46.

The first stopper portion 434 and the second stopper portion 435 are fixed in the upper portion of the movable frame 43. The first engagement portion 472 of the upper shift lever 47 is contacted with and released from the first stopper potion 434, and the second engagement portion 473 of the upper shift lever 47 is contacted with and released from the second stopper portion 435. A holding member 475 is supported on the shaft 474 studded on the leading edge portion of the upper shift lever 47, so that the holding member 475 is freely oscillated.

In the same manner, the first stopper member 436 and the second stopper member 437 are fixed in the lower portion of the movable frame 43. The first engagement portion 482 of the lower shift lever 48 is contacted with and released from the first stopper portion 436. The second engagement portion 483 of the lower shift lever 48 is contacted with and released from the second stopper portion 437. A holding member 485 is supported on a shaft 484 studded on the leading edge portion of the upper shift lever 47, so that the holding member 485 is freely oscillated.

The holding member 475 has 2 holding portions, and is supported by a shaft 474 so that the holding member 475 can be oscillated. Further, the holding member 485 also has 2 holding portions, and is supported by a shaft 484 so that the holding member 485 can be oscillated. Accordingly, when the shift levers 47 and 48 are oscillated and hold both surfaces of the sheet P in pressure-contact with the surfaces, the holding members 475 and 485 do not contact with only one surface of the obverse and reverse surfaces, but uniformly and assuredly pressure-contact with respective 2 portions of the obverse and reverse surfaces of the sheet P.

Figure 9:
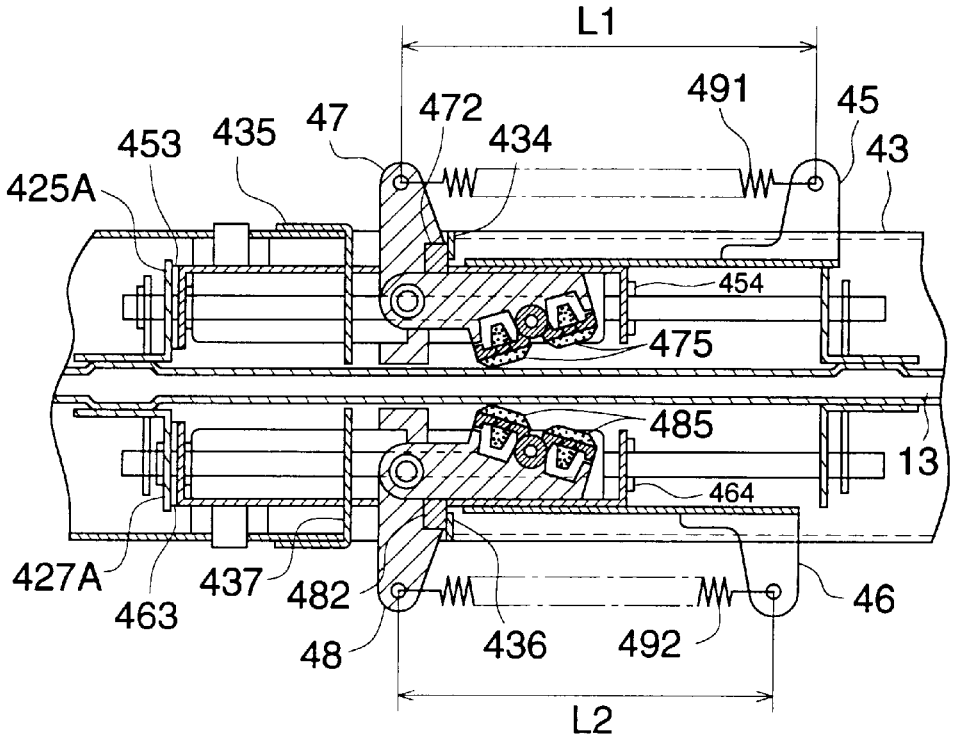
FIGS. 9(*a*) and 9(*b*) are sectional views showing operation processes of a shift lever by the shift means.
Figure 9:
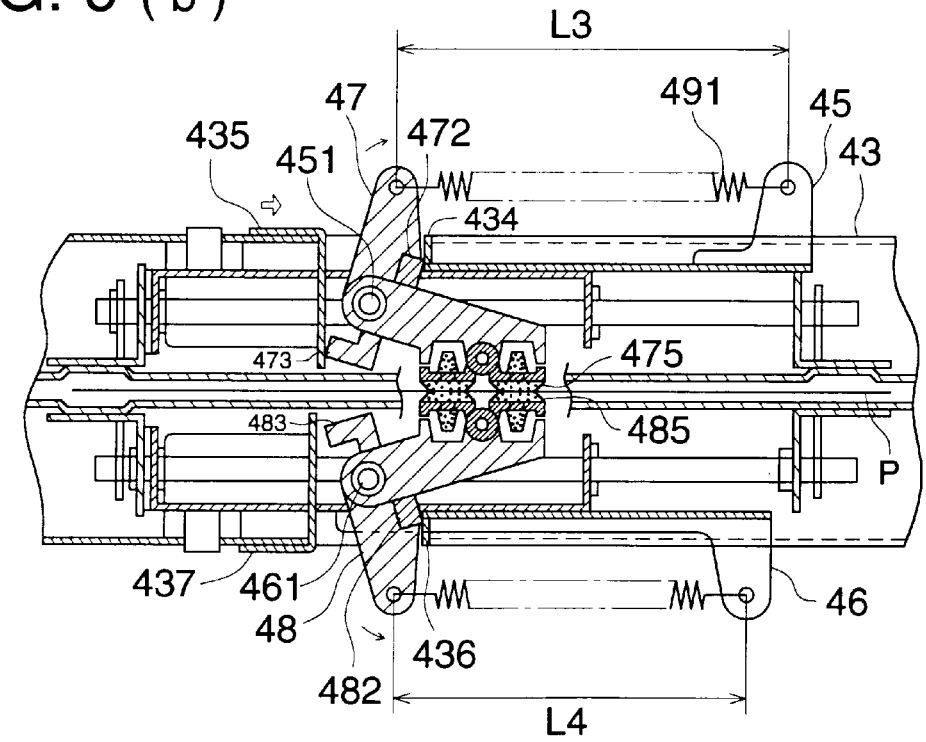

FIGS. 9(*a*), 9(*b*), 10(*a*) and 10(*b*) are sectional views showing operation processes of the shift levers 47 and 48 by the shift means 40.

FIG. 9(*a*) shows a waiting position at the home position of the movable frame 43. In this waiting position, one side end of the movable holding member 45 contacts a supporting member 425A through a buffer member 453; the first engagement portion 472 of the shift lever 47 contacts the first stopper portion 434 provided on the movable frame 43 which is stopped; and the holding member 475 supported by the shift lever 47 is separated from the path 13 for sheet conveyance. In the same manner, one side end of the movable holding member 46 contacts a supporting member 427A through a buffer member 463; the first engagement portion 482 of the shift lever 48 contacts the first stopper portion 436 provided on the movable frame 43, which is stopped; and the holding member 485 supported by the shift lever 48 is separated from the path 13 for sheet conveyance. When the path 13 is opened, the leading edge portion of the sheet P passes.

FIG. 9(*b*) shows a condition in which the movable frame 43 is slightly moved in the right direction as shown in the drawing. When the movable frame 43 is moved, the first stopper portions 434, 436 and the second stopper portions 435, 437 which are integrated with the movable frame 43, are also moved. When these stopper portions are moved, the shift lever 47 can be oscillated, and is oscillated clockwise around a shaft 451, which is in the stopped position, by the spring force of the coil spring 491. The first engagement portion 472 contacts the first stopper portion 434, and the second engagement portion 473 contacts the second stopper portion 435, and the shift lever 47 is stopped. In the same manner, when each stopper portion is moved, the shift lever 48 can be oscillated. The shift lever 48 is oscillated clockwise around a shaft 461, which is in a stopped position, by the spring force of the coil spring 492. The first engagement portion 482 contacts the first stopper portion 436, and the second engagement portion 483 contacts the second stopper portion 437, and the shift lever 48 is stopped. In this stop position, a distance L3 between the upper end portion of the shift lever 47 and the upper end portion of the movable holding member 45, is smaller then a distance L1 between them in the waiting position. Further, a distance L4 between the lower end portion of the shift lever 48 and the lower end portion of the movable holding member 46, is also smaller than a distance L2 between them in the waiting position. In this condition, the holding member 475 supported by the leading edge portion of the shift lever 47 so that it can be oscillated, and the holding member 485 supported by the leading edge portion of the shift lever 48 so that it can be oscillated, are in pressure-contact with each other by the spring force of the coil springs 491 and 492, and hold the trailing edge of the sheet P.

Parts of the same mechanical specification are used for the coil springs 491 and 492. The distance L1 between the upper end portion of the shift lever 47 and the upper end portion of the movable holding member 45, is set to be larger then the distance L2 between the lower end portion of the shift lever 48 and the lower end portion of the movable holding member 46. Accordingly, the spring tension (the pulling force) at the distance L1 is larger than that at the distance L2. In the same manner, the spring tension (the pulling force) at the distance L3 is larger than that at the distance L4.

In FIG. 9(*b*), in the case where the shift lever 47 forced by the coil spring 491, having the larger spring tension, is stopped, when the first engagement portion 472 contacts the first stopper portion 434, and the second engagement member 473 contacts the second stopper portion 435, the second engagement portion 483 of the shift lever 48 forced by the coil spring 492, having the smaller spring tension, is set such that the second engagement portion 483 does not contact the second stopper portion 437 and is separated from the second stopper portion 437. Therefore, the shift lever 48 has the degree of freedom for oscillation. Accordingly, with respect to the holding member 475, which is stopped at a predetermined position by being forced by the larger spring tension, the holding member 485 which is forced by the smaller spring tension, is in pressure-contact, and holds the sheet P flatly without deforming it.

Figure 10:
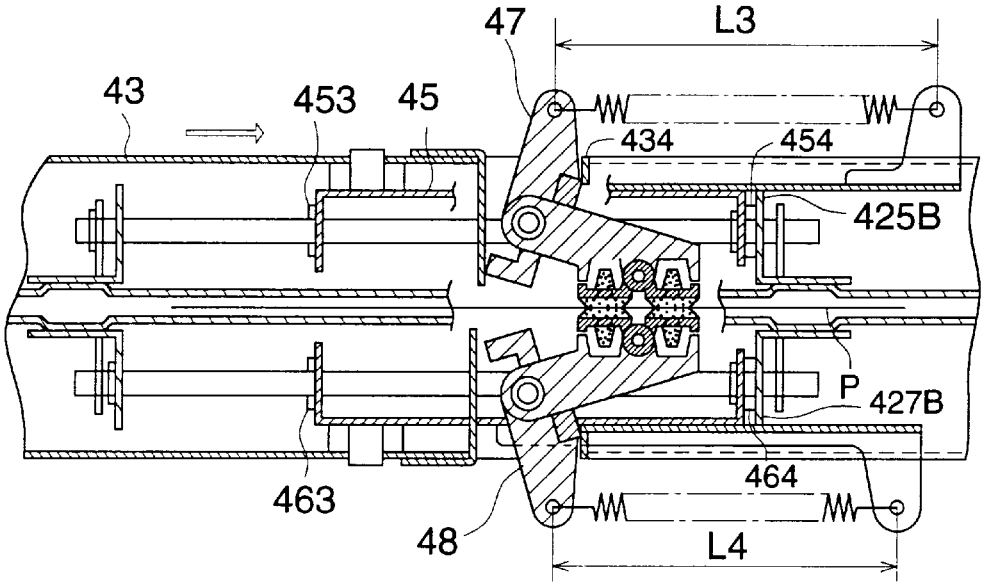
FIGS. 10(*a*) and 10(*b*) are sectional views showing operation processes of the shift lever by the shift means.
Figure 10:
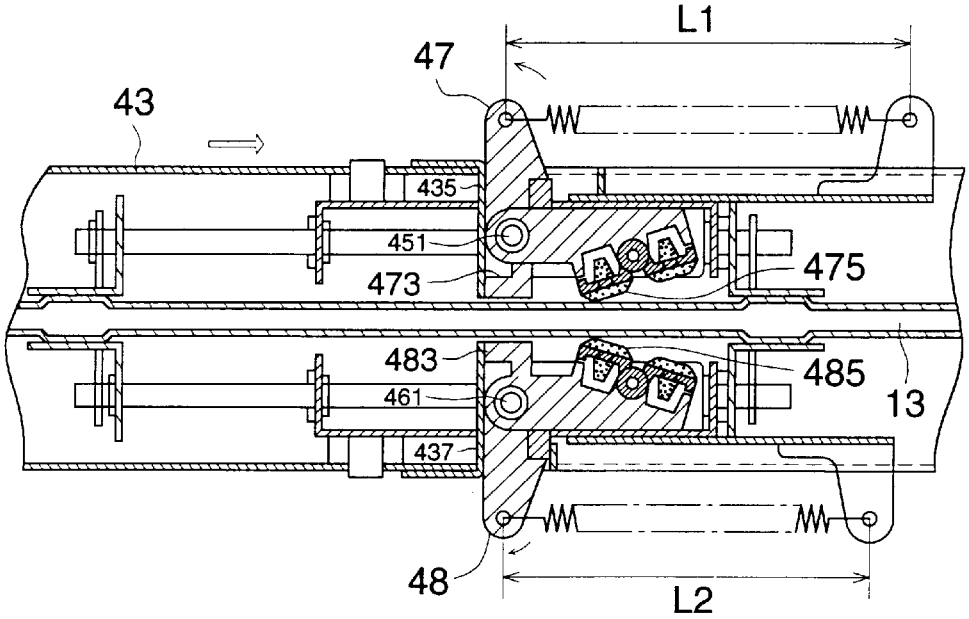

FIG. 10(*a*) shows a condition of movement in which the movable frame 43 is moved by a predetermine distance in the right direction in the drawing. When drive of the Motor M6 starts, the crank arm 45 is oscillated, and the movable frame 43 is linearly moved reciprocally in the direction perpendicular to the sheet conveyance direction. When the movable frame 43 is moved in the right direction in the drawing, the shift levers 47 and 48 are moved by a predetermined distance while the sheet is being held, as shown in FIG. 9(*b*), so that the sheet P is shifted. At a position in which the shift operation has been completed, one side end of the movable holding member 45 contacts the supporting member 425B through the buffer member 454, and stops. Simultaneously, the other side end of the movable holding member 45 contacts the supporting member 427B through the buffer member 464, and stops.

FIG. 10(*b*) shows a condition of completion of the shift operation. When the movable frame 43 reaches the maximum movement position by the crank arm 45, the second stopper portion 435 of the movable frame 43 presses the second engagement portion 473 of the shift lever 47, oscillates the shift lever 47 counterclockwise around the shaft 451, and withdraws the holding member 475 above the path 13. Simultaneously, the second stopper portion 437 of the movable frame 43 presses the second engagement portion 483 of the shift lever 48, oscillates the shift lever 48 clockwise around the shaft 461, and withdraws the holding member 485 below the path 13.

After shift processing has been completed as shown in FIG. 10(*b*), application of voltage onto the solenoid SD2 is switched OFF, the driven roller (the lower roller) 4B of the pair of conveyance rollers 4 is forced by the spring and presses the drive roller (the upper roller) 4A, nips the trailing edge of the sheet between the pair of conveyance rollers 4, and starts conveying.

Figure 11:
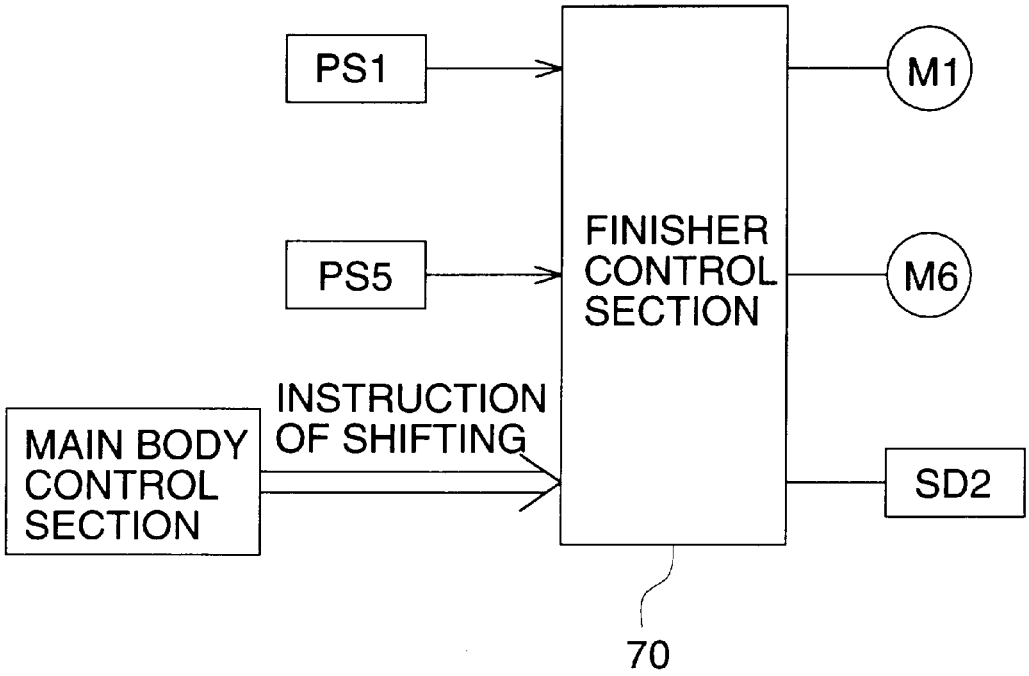
FIG. 11 is a block diagram showing the control of the shift means in the sheet finishing apparatus.
Figure 12:
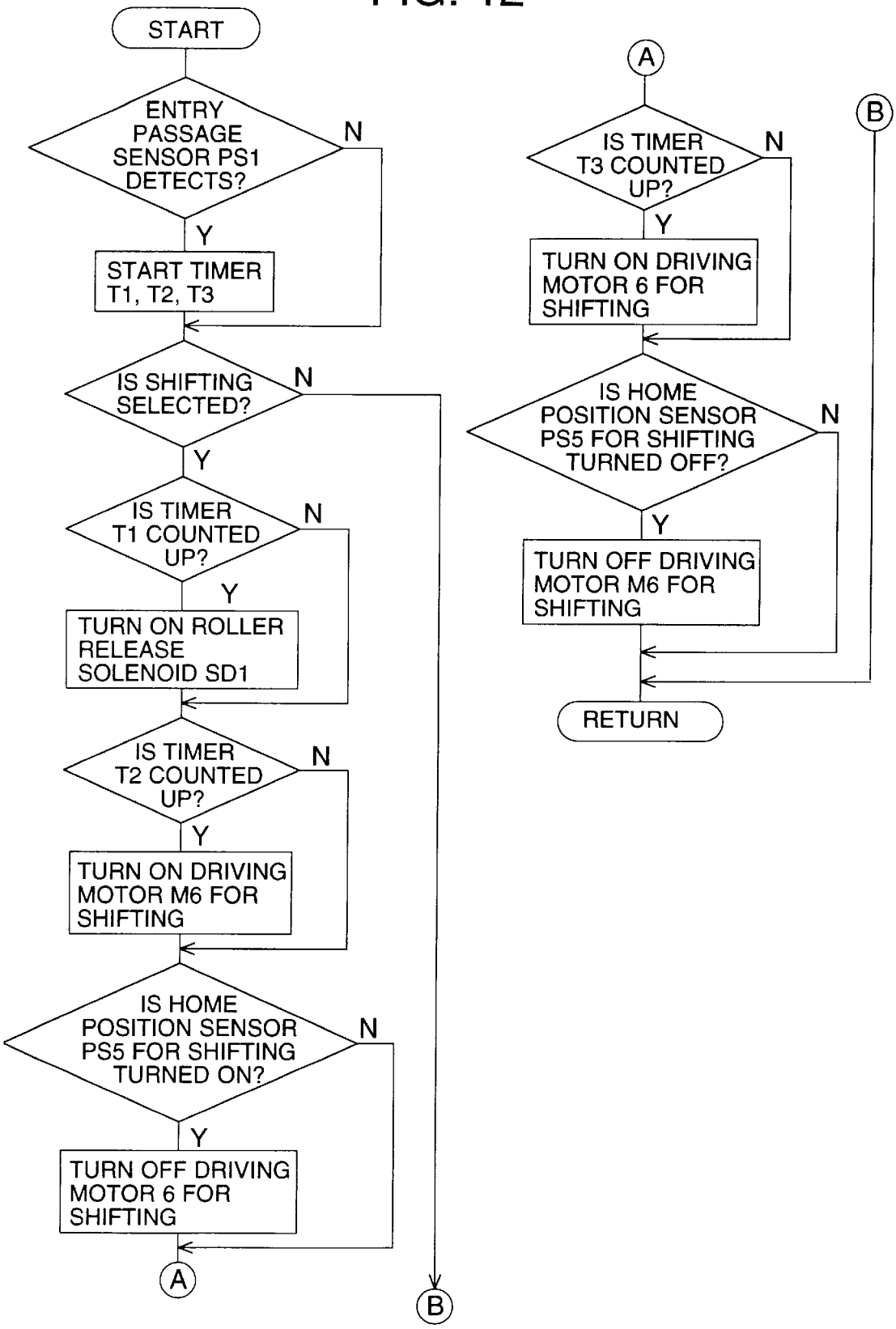
FIG. 12 is a flow chart of the shift means.
Figure 13:
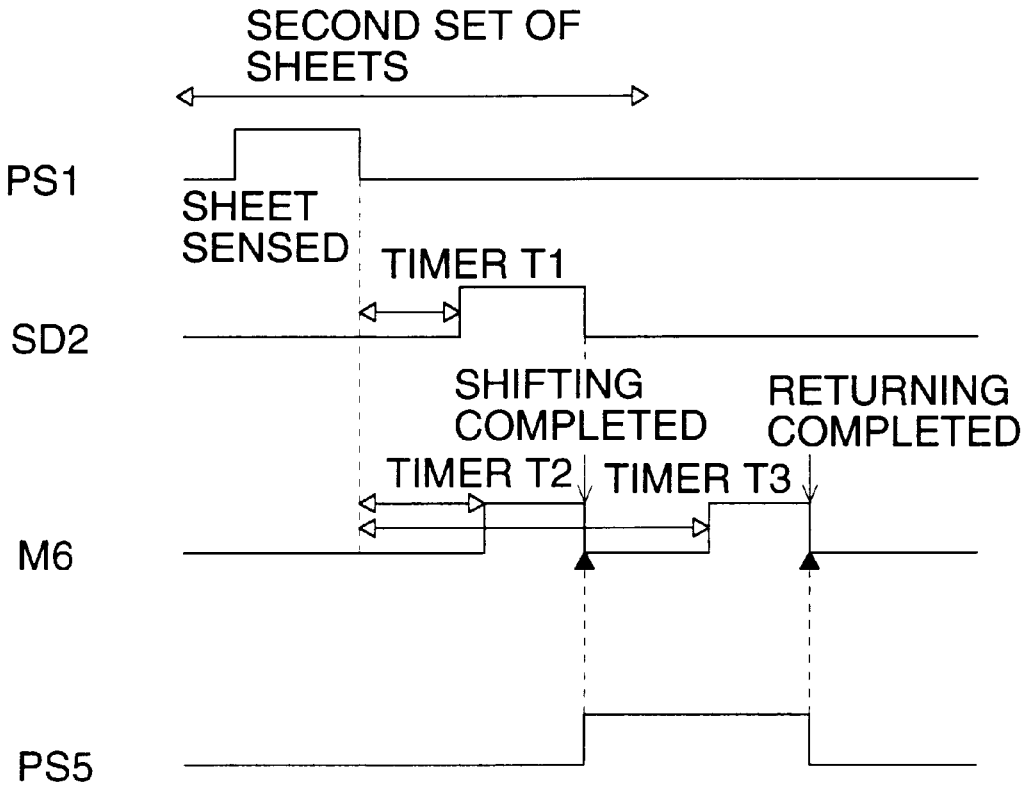
FIG. 13 is a time chart of the shift means.
Figure 14:
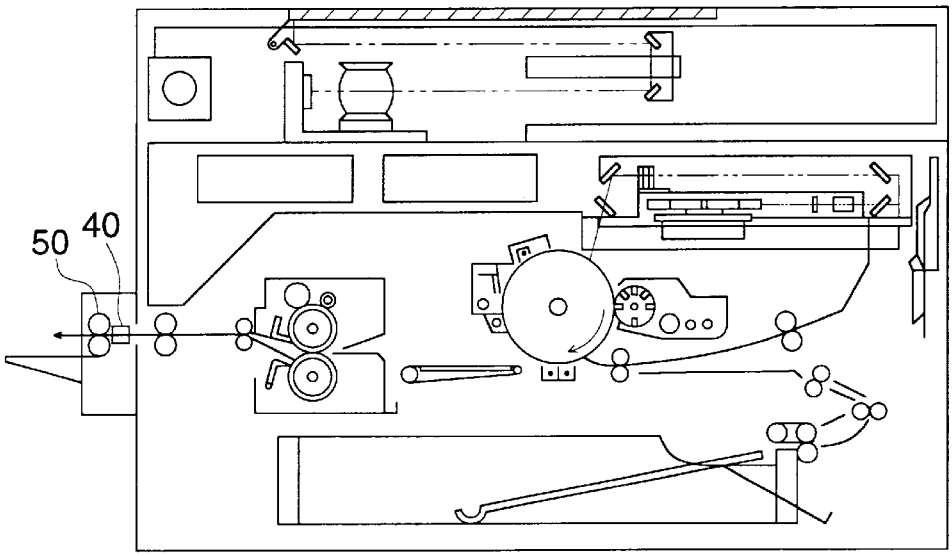
FIG. 14 is a view showing the structure of an image forming apparatus, such as an electrophotographic copier, or similar apparatus, provided with a sheet sorting apparatus.
Figure 15:
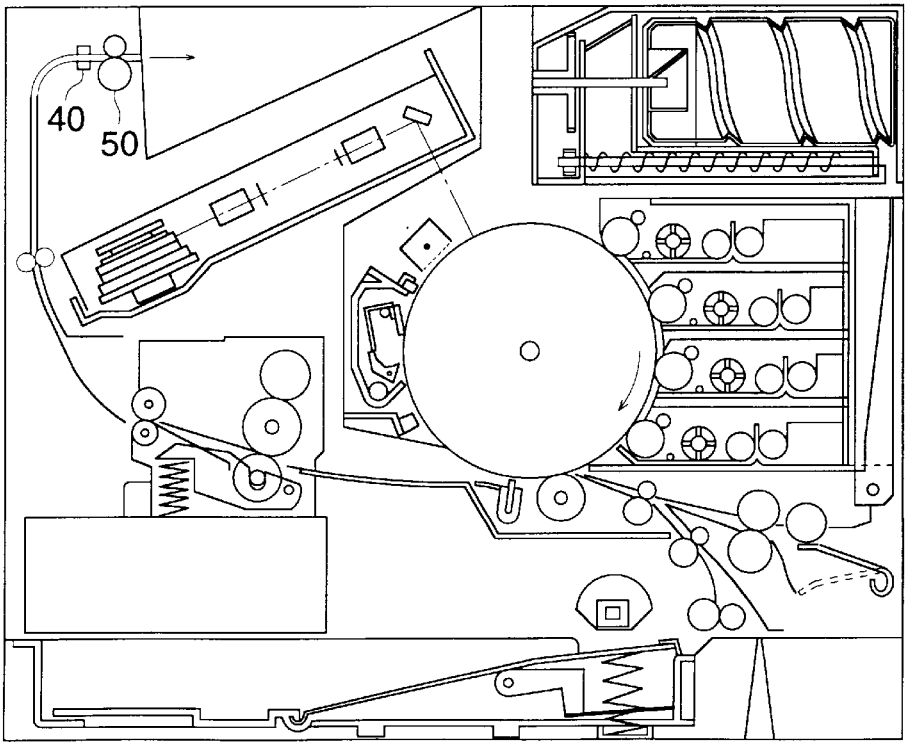
FIG. 15 is a view showing the structure of an image forming apparatus such as a printer, or similar apparatus, provided with a sheet sorting apparatus.

FIG. 11 is a block diagram showing the control of the shift means in the sheet finisher, FIG. 12 is a flow chart of the shift means, and FIG. 13 is a time chart of the shift means. When passage of the trailing edge of the sheet, sent from the sheet delivery section of the image forming apparatus to the sheet finisher, is detected by an entry passage sensor PS1, counting of timers T1, T2 and T3 is started in the control section (the control means) 70. By counting up of the timers T1, T2 and T3, drive of a release solenoid SD2 of the pair of conveyance rollers 4 and the shift driving motor M6 is respectively started. Herein, sheets are classified into groups according to sizes, and time for timers T1, T2 and T3 is respectively set corresponding to each group.

(1) After passage of the trailing edge of the sheet P, conveyed from the entry portion of the sheet finisher C, has been detected by the entry passage sensor PS1, the contact-pressure of the pair of conveyance rollers 4 is released by the solenoid SD2 after predetermined time, during which the trailing edge of the sheet passes the nip position of the pair of the conveyance rollers 3, has passed.

(2) When the motor M6 is driven and the movable frame 43 is moved by the eccentrical movement of the crank arm 442, the shift levers 47 and 48 pressure-contact and hold the sheet P, and shift it by a predetermined distance. After shifting has been completed, the shift levers 47 and 48 separate the sheet P.

(3) Next, the pair of conveyance rollers 4 are in pressure-contact with each other by the solenoid SD2 and hold near the trailing edge of the sheet P, and the sheet P is conveyed to the downstream side by the pair of conveyance rollers 4 rotated by the motor M1.

(4) When the trailing edge of the sheet is detected by the sensor PS2 after the trailing edge of the sheet has passed the nip position of the pair of conveyance rollers 4, a voltage is applied on the solenoid SD1, and the upper roller 5A of the pair of discharging rollers 5 is forced by the spring, and presses the lower roller 5B. The upper roller 5A and the lower roller 5B, which are rotated by the motor M2, are rotated at lower speed than the pairs of conveyance rollers 1, 2, 3 and 4, which are rotated by the motor M1. Accordingly, the sheet P, passed through the nip position of the pair of conveyance rollers 4, is in pressure-contact with the pair of discharging rollers 5 and held by the pair of discharging rollers 5, and delivered onto the delivery sheet tray 6 at low speed. By this low speed sheet delivery, the sheet P is appropriately stacked on the delivery sheet tray 6 without disorder. Incidentally, although it is not shown in the drawing, the shift means can also be passed after staple processing. By this operation, stapled sets of sheets can be delivered by alternately shifting each set of sheets in the direction perpendicular to the delivery direction. Therefore, even when stapled set of sheets is successively stacked, the stapled portion is not overlapped. Thereby, it can be prevented that only the stapled portions of the stacked sets of sheets become thicker, and the overall volume is increased, and that the stacked sets of sheets are inclined. Thereby, many more sets of sheets can be stacked.

As described above, the sheet sorting apparatus of the present invention is not such an apparatus in which sheets are shifted by shifting the delivery sheet tray. Accordingly, complication of the apparatus, an increase of the overall size, an increase of power consumption, an increase of the overall size of a tray driving motor, etc., can be prevented. Further, the delivery sheet tray, on which sheets are stacked, is not shifted, and thereby, there is no possibility that sorted sheets are irregularly aligned. Furthermore, the shift means are separately provided from the holding and conveying means (a pair of conveyance rollers), and therefore, the shift means is driven only for shifting the sheets, and the holding and conveying means may be driven only for holding and conveying the sheets. Accordingly, the driving control system can be more simplified than a conventional sheet sorting apparatus with mechanisms having both these functions. Still further, a load onto the driving system such as a driving gear can also be decreased, and thereby, an increase of the wear resistivity, durability, reliability, etc., can be attained.

When the sheets are shifted by the shift means, the present apparatus is structured such that holding by at least one holding and conveying means is released. Therefore, the length of the sheet conveyance path between the first and the second holding and conveying means is not required to be longer than it needs. The apparatus is compact and sheet delivery by shifting can be appropriately carried out without occurrence of wrinkling.

The contact portion of at least one holding member is supported so that it can be oscillated, and therefore, it can be prevented that the sheet is held by only one point. Thereby, sheet can be prevented from curling at shifting.

A problem of irregular alignment of sheet, caused by shifting the sheet when the leading edge of sheet delivered while being shifted, contacts the sheet which is already delivered onto the delivery sheet tray, can be prevented, wherein the problem tends to occur when the sheet delivery means also has a function of the shift means. Further, to shift the sheet delivery means near the delivery sheet exit with which the operator tends to contact, makes the operator more dangerous in the use of the apparatus. Accordingly, the present invention can avoid such a danger. Still further, if the sheet delivery means also has the function of the shift means, and further it is structured such that holding can be released, the structure and control of the apparatus become complicated. The present invention can also prevent such a problem.

Furthermore, the following excellent effects can be obtained. By adding the shift means to the sheet delivery means, the number of components of the sheet sorting apparatus can be reduced. Further, the sheet delivery means delivers the sheet at low speed, and therefore, sheet delivery by shifting the sheet can be appropriately conducted. Still further, even when the leading edge of the sheet delivered while being shifted, contacts the sheet, which has been delivered onto the delivery sheet tray, the sheet stacked on the delivery sheet tray is not largely shifted, and sheet alignment is securely carried out.

Figure 16:
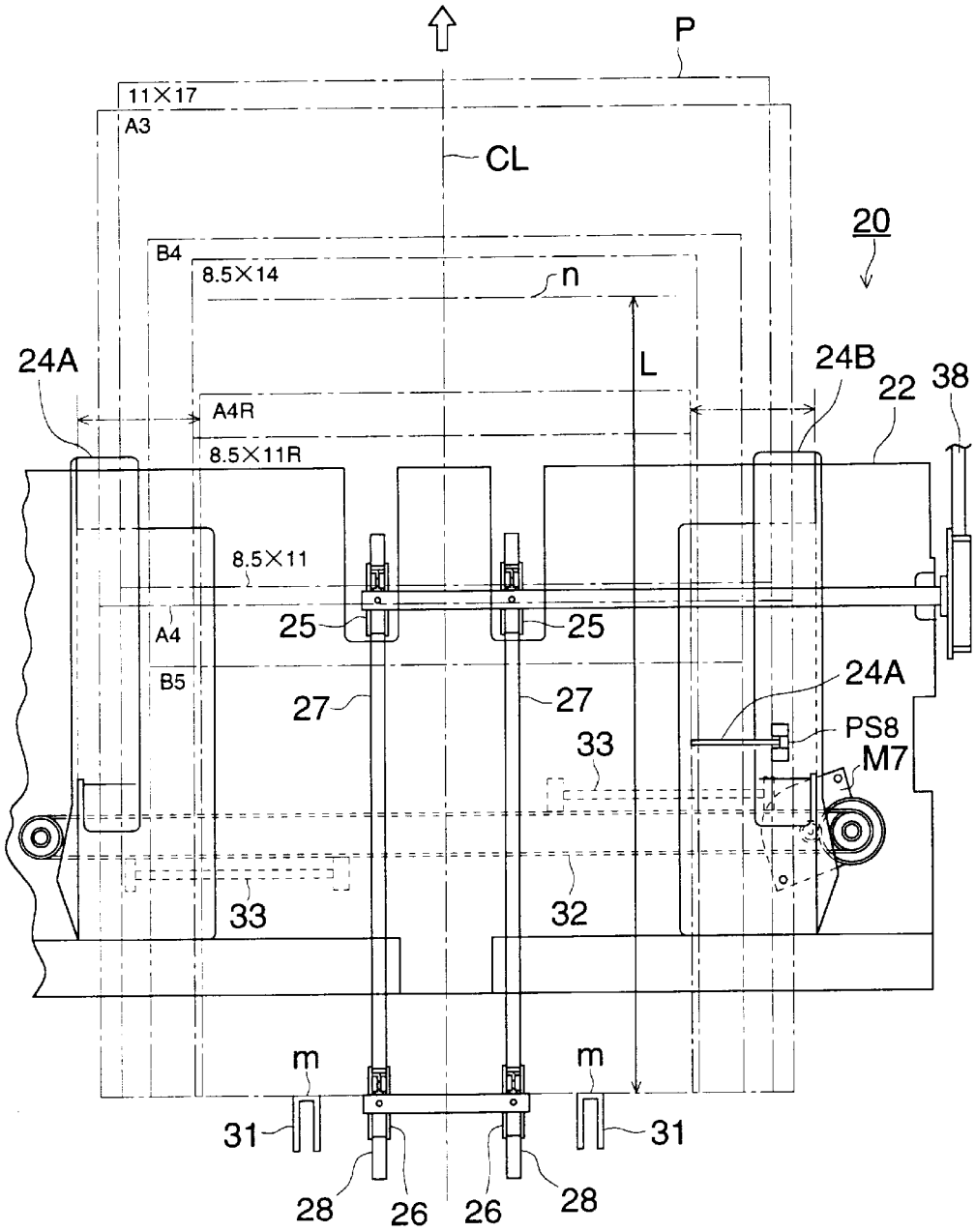
FIG. 16 is a plan view of a staple processing section.

Next, in the sheet finisher of the present invention, the staple processing section used in the above-described sheet sorting apparatus, will be described. FIG. 16 is a plan view of a stapling section 20. In FIG. 16, two alignment members 24 are arranged symmetrically with respect to a center line CL, and can be simultaneously moved in the direction perpendicular to the conveyance direction of the sheet P. The left and right alignment members 24 are respectively fixed to a timing belt 32, and slide and move along a guide bar 33. The timing belt 32 is rotated by a stepping motor M7 through an intermediate gear train. FIG. 16 shows a condition in which the alignment members 24 are in the home position. This home position is detected and controlled by a protrusion (a detected portion) 24A provided on the alignment member 24, and a home position detecting sensor 34 provided on the intermediate stacker 22. Incidentally, one-dotted chain lines used in FIG. 16 show various sizes of sheets P. In the present example, as an example, various sizes of sheets P such as size A3, size B4, 11"×17", 8.5"×14", are set to be large sized sheets, and smaller sized sheets P are set to be small sized sheets. A distance L from a stopper surface (a collision surface) m, with which the sheet collides, of a stopper member 31 near the stapler 30 to a nip position n of the pair of discharging rollers 5, is set corresponding to a position to distinguish the large size from the small size. That is, because the length in the conveyance direction of the small sized sheets P is smaller than the distance L, the small sized sheets P are placed on the upstream side of the pair of discharging rollers 5. In contrast to this, because the length in the conveyance direction of the large sized sheets P is larger than the distance L, the leading edge portion of the sheets P projects from the nip position of the pair of discharging rollers 5 to the downstream side, and is also stacked on the delivery sheet tray 6. In order to stack the large sized sheets, and to align and staple them, the nip portion of the pair of discharging rollers 5 is controlled to be opened/closed.

Figure 17:
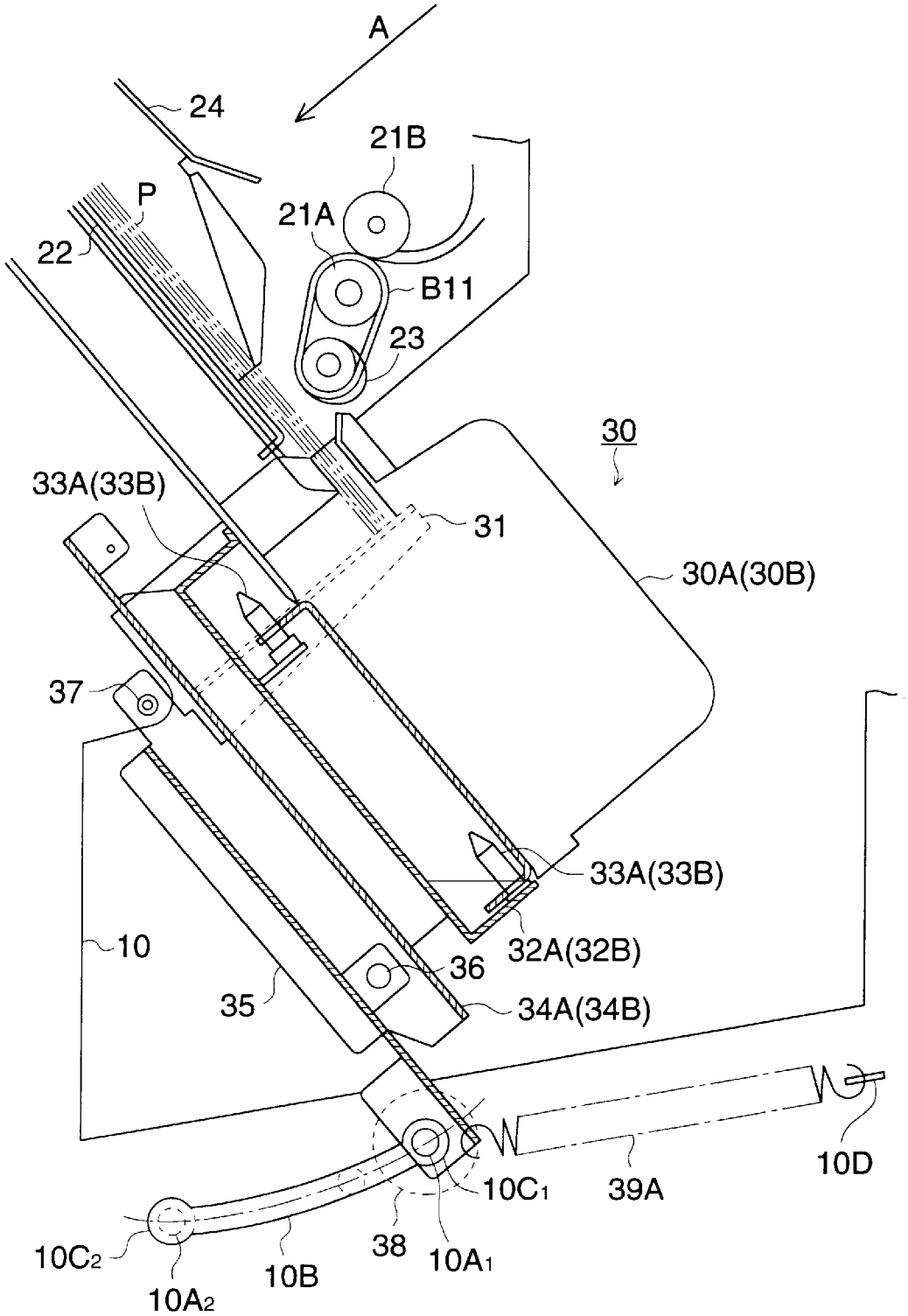
FIG. 17 is a sectional view showing a staple processing condition of a staple means.
Figure 18:
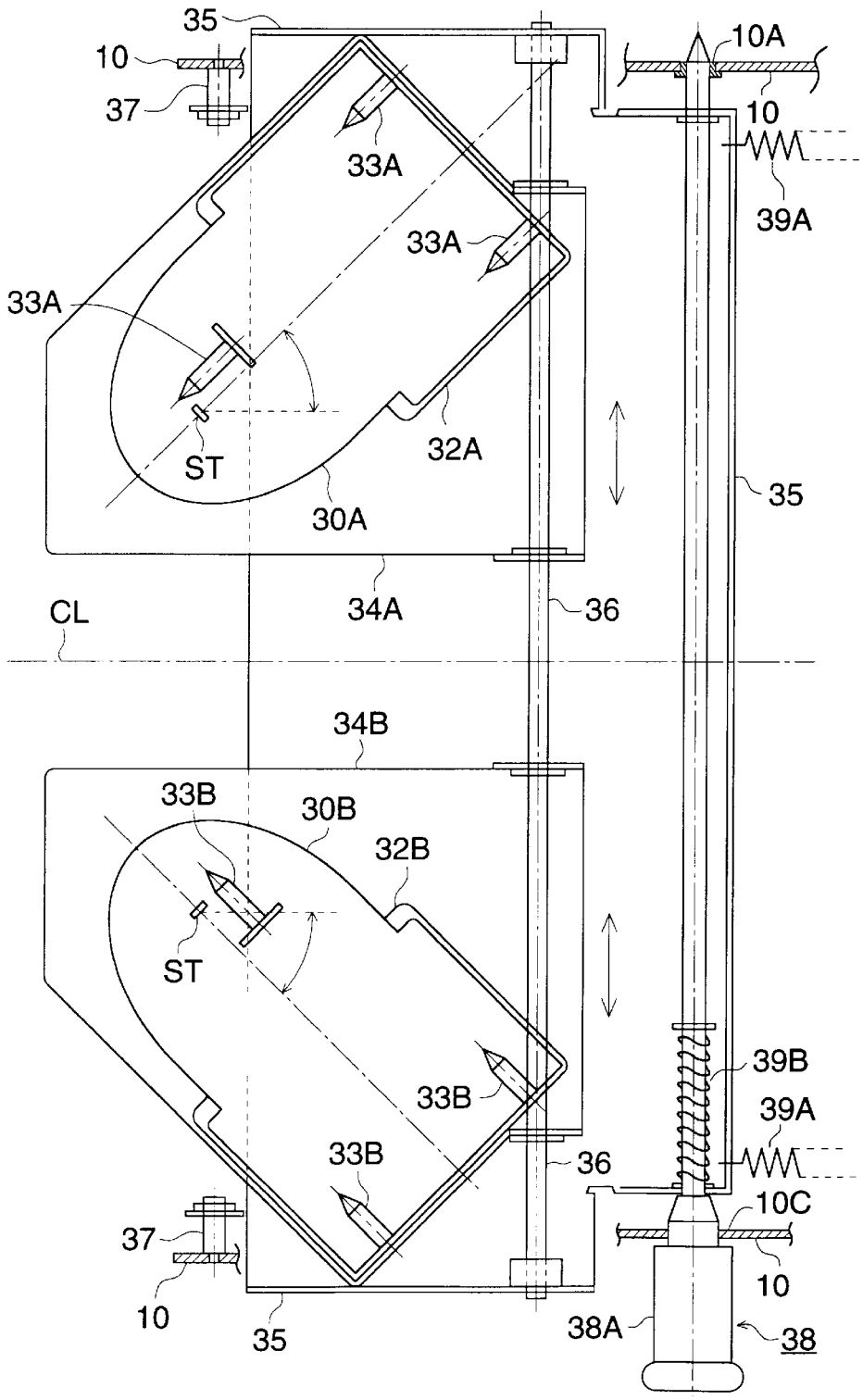
FIG. 18 is a plan view of the staple means viewed from the direction of an arrow A in FIG. 17.

FIGS. 17, 18, 19 and 20 show the first example of the present invention, FIG. 17 is a sectional view showing a staple processing condition of the staple means 30, and FIG. 18 is a plan view of the staple means 30, viewed from the direction arrowed by A.

In FIGS. 17 and 18, 2 staple units 30A and 30B are symmetrically arranged horizontally with respect to the center line CL, and the bottom portion of the far side staple unit 30A is engaged with 3 positioning pins 33A provided on the supporting base 32A, so that the staple unit 30A can be attached to and detached from the supporting base 32A. In the same manner, the bottom portion of the near side staple unit 30B is engaged with 3 positioning pins 33B provided on the supporting base 32B, so that the staple unit 30B can be attached to and detached from the supporting base 32B. The supporting bases 32A and 32B are respectively arranged on the moving base plates 34A and 34B, and can be simultaneously oscillated by an oscillation angle of 45° with respect to the center line CL by the oscillation driving means, which will be described later. The moving base plates 34A and 34B are arranged on the oscillation base plate 35, and can slide along the rail shaft 36 and linearly move.

A fixed pin 37 studded on the main body base plate 37 is engaged with one end portion of the oscillation base plate 35, and the oscillation base plate 35 can be oscillated around the fixed pin 37. An engagement knob member 38 is inserted into a through hole provided on the other end portion of the oscillation base plate 35 so that the engagement knob member 38 can slide in the through hole. The leading edge portion of the engagement knob member 38 is inserted into reference hole portions $\mathbf{10}A_1$ and $\mathbf{10}A_2$ of the far side main body base plate 10 so that it can be attached to and detached from the reference hole portions $\mathbf{10}A_1$ and $\mathbf{10}A_2$. A shaft portion near the knob portion 38A of the engagement knob member 38 is idly engaged with a long groove portion 10B of the near side main body base plate 10. A shaft portion nearest the knob portion 38A of the engagement knob member 38 is engaged with reference holes $\mathbf{10}C_1$ and $\mathbf{10}C_2$ provided on both end portions of the long groove portion 10B, so that the oscillation base plate 35 is positioned. The long groove portion 10B, and the reference holes $\mathbf{10}C_1$ and $\mathbf{10}C_2$ of both end of the long groove portion 10B form a uniform radius circular arc around the fixed pin 37. The other end of a coil spring 39A, one end of which is held on a holding portion 10D of the main body base plate 10, is hooked on an end of the oscillation base plate 35, and the oscillation base plate 35 is forced by the spring in one direction. A coil spring 39B is housed in the engagement knob member 38, and forces the engagement knob member 38 to be inserted into reference holes $\mathbf{10}A_1$, $\mathbf{10}A_2$, $\mathbf{10}C_1$ and $\mathbf{10}C_2$ of the main body base plate 10.

Figure 19:
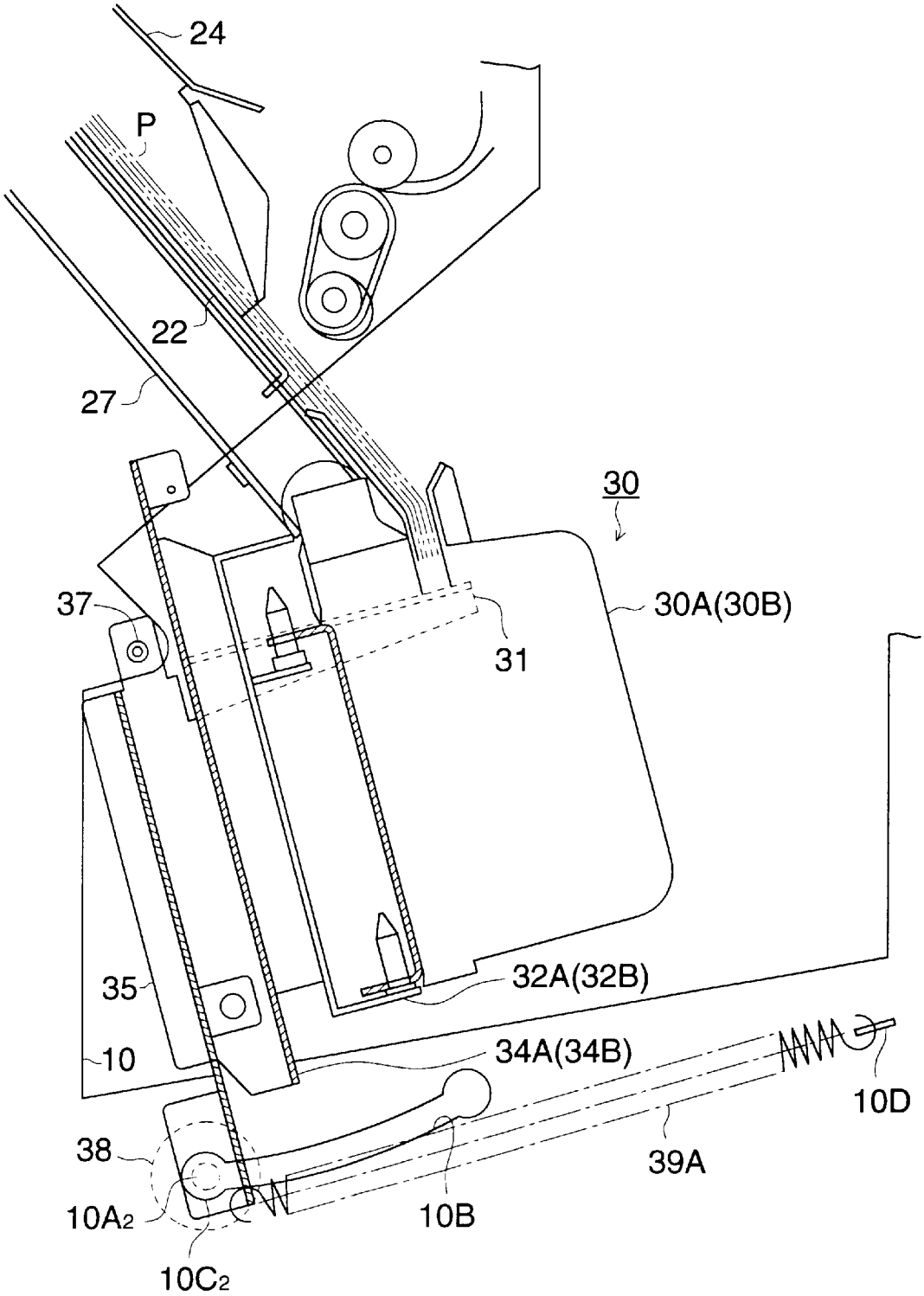
FIG. 19 is a sectional view showing a condition in which the staple means is oscillation-operated.

FIG. 19 is a sectional view showing a condition in which the staple means 30 is oscillated. The knob portion 38A of the engagement knob member 38 is gripped, and pulled this side against the spring force of the coil spring 39A; after the shaft portion of the knob member 38 has been pulled out of reference holes $\mathbf{10}A_1$, $\mathbf{10}C_1$ on one side of the main body base plate 10, the knob member 38 is gripped and oscillated around the fixed pin 37 against the coil spring 39A; the knob member 38 is inserted into reference holes $\mathbf{10}A_2$ and $\mathbf{10}C_2$ on the other side; and the knob member 38 is held to be stationary. By this oscillation operation of the knob member 38, the oscillation base plate 35 integrated with the knob member 38, moving base plates 34A and 34B mounted on the oscillation base plate 35, supporting bases 32A and 32B, and staple units 30*a* and 30B, are integrally oscillated around the fixed pin 37, and the staple means 30 is withdrawn and stopped. In this withdrawn condition, a sheet guiding portion of the staple means 30 and the stopper member 31 are separated from the end portion of the sets of sheets P stacked on the intermediate stacker 22, and a wide open space is formed. In this opened condition, an incorrectly stapled set of sheets occurred in the sheet guiding portion of the staple units 30A and 30B, can be gripped and easily taken out.

Figure 20:
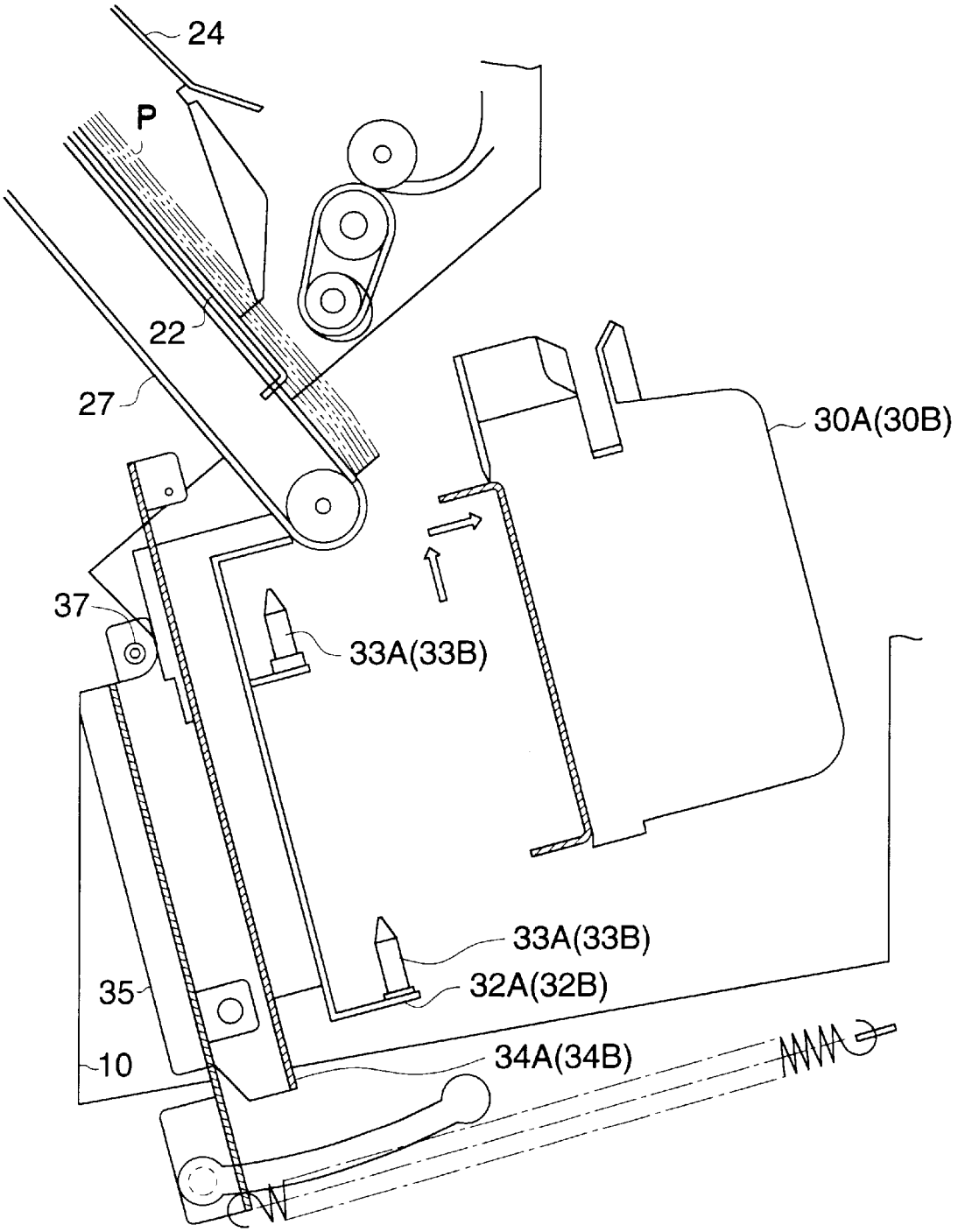
FIG. 20 is a sectional view showing a condition in which the staple unit is dismounted from a supporting base.

FIG. 20 is a sectional view showing a condition in which the staple units 30A and 30B are removed from the supporting base. Because attachment and detachment mechanism and attachment and detachment operations of the staple units 30A and 30B are the same, hereinafter the staple unit 30A will be explained as a representative. After the staple means 34 has been withdrawn, initially, a lock means, not shown, is released; the staple unit 30A is held, and moved along the axial direction of the positioning pin 33A and disengaged from the positioning pin 33A; and then, the staple unit 30*a* is lifted upward, and removed from the supporting base 32A. In this removed condition of the staple unit 30A, repairing operations and inspection of the staple unit 30A or the supporting base 32A, removal of dropped staple pins, or similar operations, can be easily carried out.

Figure 21:
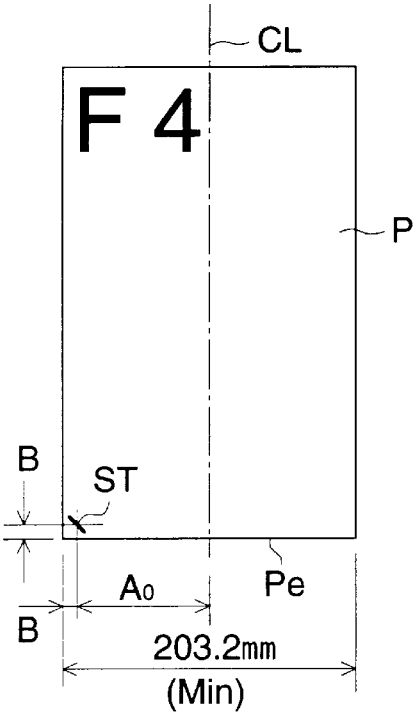
FIGS. 21(*a*) through 21(*h*) are plan views respectively showing an example in which a corner of a sheet is stapled by the staple unit.
Figure 21:
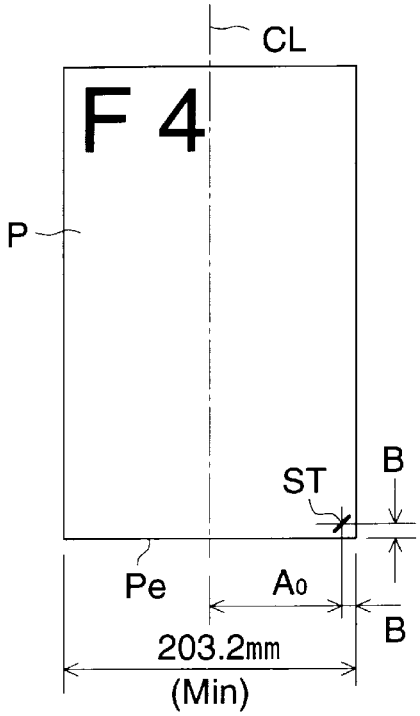
Figure 21:
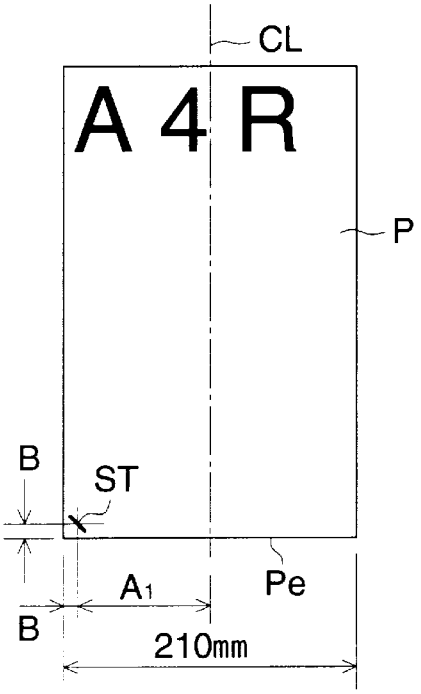
Figure 21:
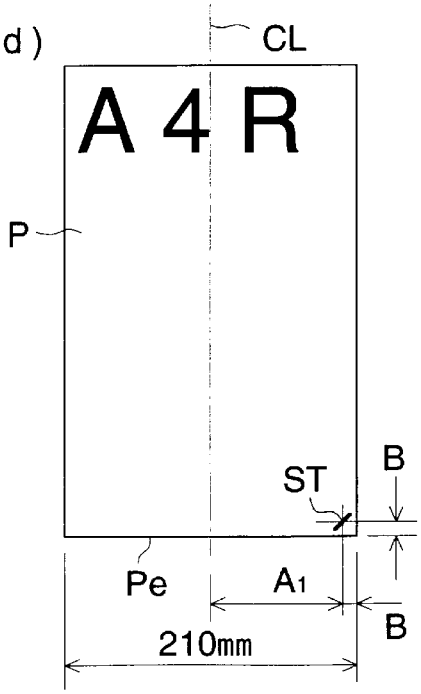
Figure 21:
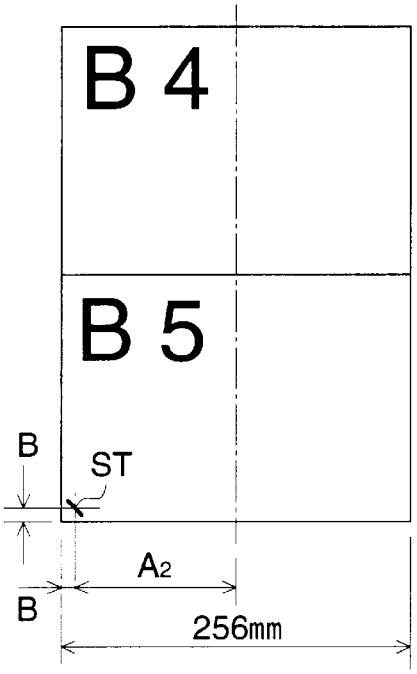
Figure 21:
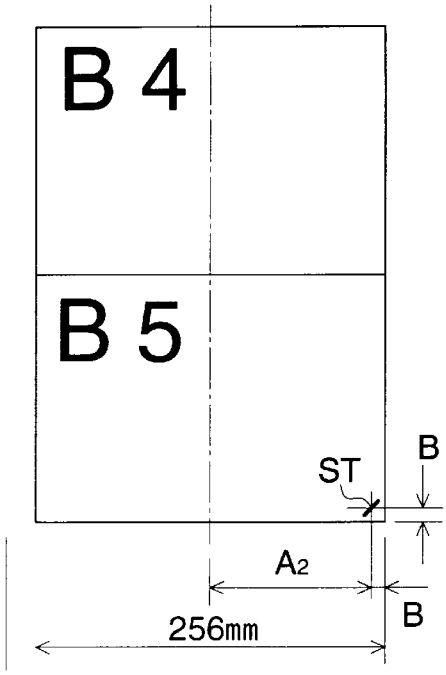
Figure 21:
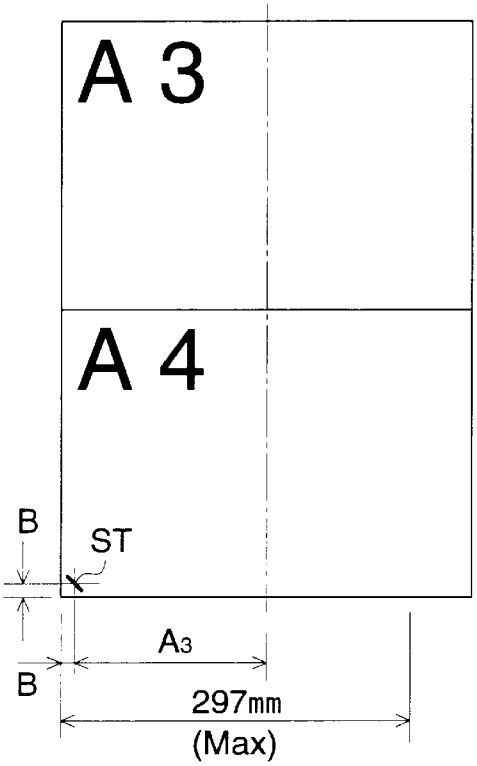
Figure 21:
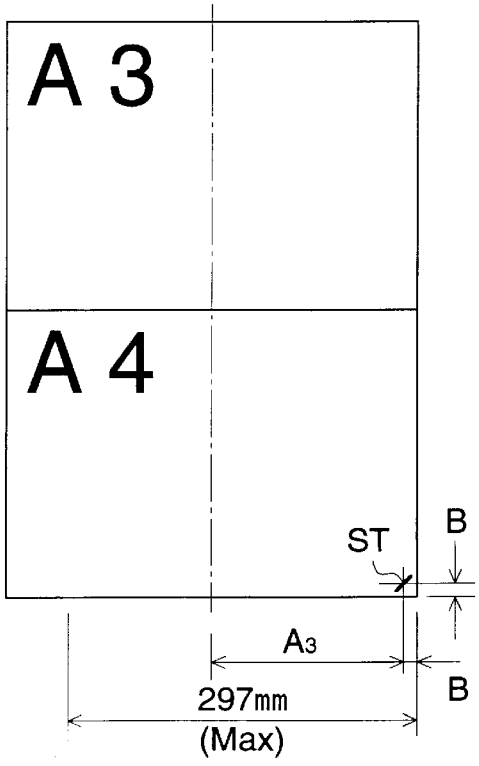

FIGS. 21(*a*) through 28 show the second example of the present invention. FIGS. 21(*a*) through 21(*h*) are plan views showing positions of one staple pin ST pinned on one end portion of various sized sets of sheets P. In these drawings, $A_0$, $A_1$, $A_2$, $A_3$ are distances from the center line CL of each sheet P to the central portion of the staple pin ST, and B shows a distance from a side end of the sheet P to the central portion of the staple pin ST. The staple pin ST is stapled on a position which has an inclination angle of 45° with respect to the trailing edge portion Pe of the sheet P, and has an equal distance B (for example, B=10 mm) from both side ends of a corner portion of the sheet P.

FIG. 21(*a*) is a plan view showing an example in which one staple pin ST is stapled on the left end of the trailing edge portion Pe of the minimum width sheet P by the staple unit 30B. FIG. 21(*b*) is a plan view showing an example in which one staple pin ST is pinned on the right end of the trailing edge portion Pe of the minimum width sheet P by the staple unit 30A. In either case, a position of a distance $A_0$ from the center line CL of the sheet P to the central portion of the staple pin ST (for example $A_0$=91.6 mm), is a home position of 2 staple units 30A and 30B which are arranged with inclination. FIGS. 21(*c*) and 21(*d*) show an example in which one staple pin ST is respectively pinned on a position of distances $A_1$ (for example, $A_1$=95 mm) and B of the left end or the right end of the trailing edge Pe of A4R sized sheet P.

FIGS. 21(*e*) and 21(*f*) show an example in which one staple pin ST is respectively pinned on a position of distances $A_2$ (for example, $A_2$=118 mm) and B of the left end or the right end of the trailing edge Pe of B4 and B5 sized sheets P. FIGS. 21(*g*) and 21(*h*) show an example in which one staple pin ST is respectively pinned on a position of distances $A_3$ (for example, $A_3$=138.5 mm) and B of the left end or the right end of the trailing edge Pe of A3 and A4 sized sheets P. As described above, the pinned position of the staple pin ST is different depending on each type of sheet size, and the staple units 30A and 30B move from the minimum distance $A_0$ to the maximum distance $A_3$ from the center line CL.

Figure 22:
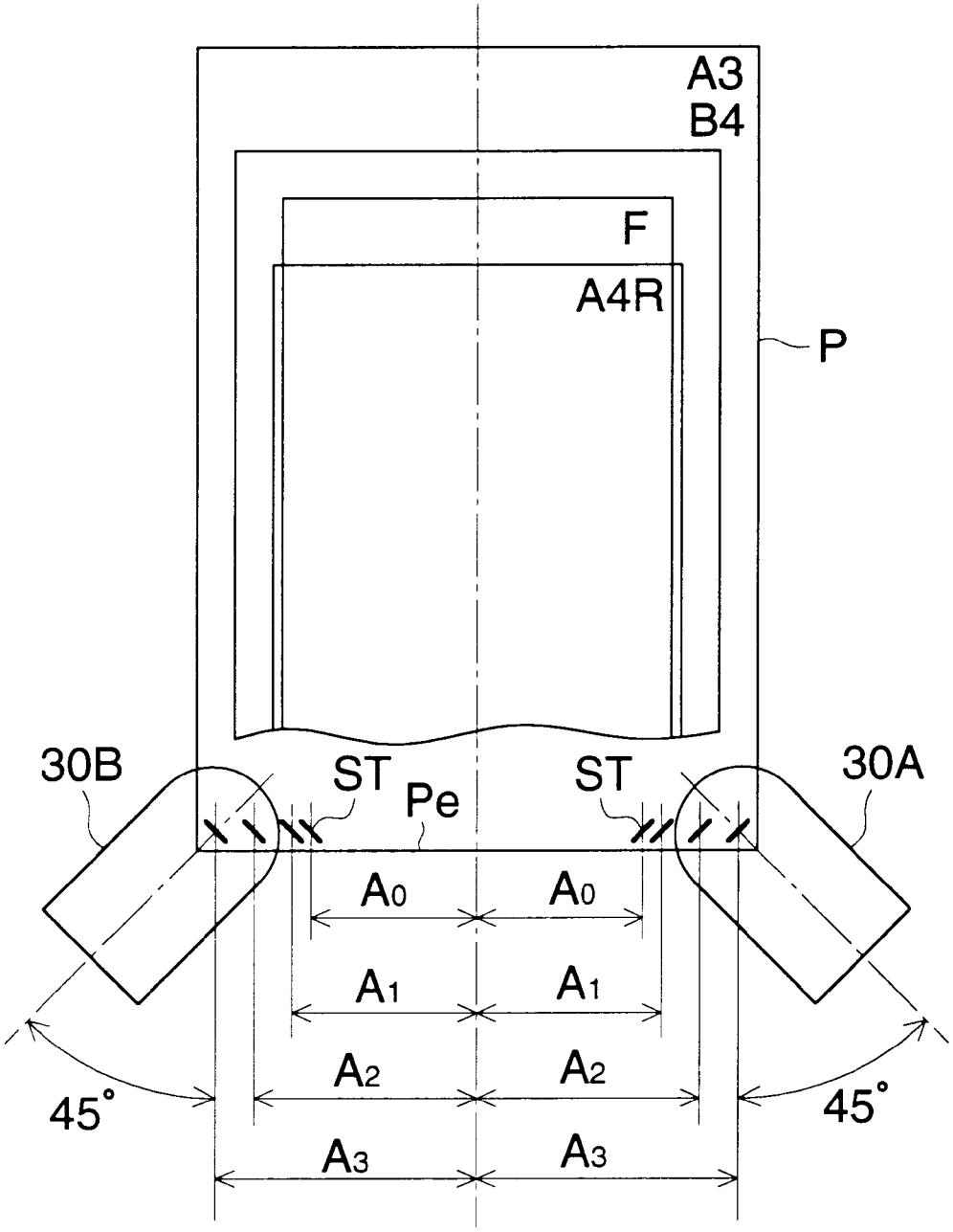
FIG. 22 is a plan view showing a movement process of the staple unit by which either end of the trailing edge portion of various sized sheets is stapled.

FIG. 22 is a plan view showing the movement process of the staple units 30A and 30B by which the staple pin ST is pinned on either one end of the trailing end portion Pe of each size of sheet P. The staple units 30A and 30B linearly move in the direction parallel with the sheet end portion Pe under the condition that the staple units 30A and 30B are arranged respectively being inclined by 45°, and pin the staple pins ST on the staple positions of predetermined distances $A_0$, $A_1$, $A_2$ and $A_3$.

FIG. 23(*a*) is a plan view showing a condition in which staple pins ST are pinned on 2 portion of equal distance positions with respect to the center line CL of each size of sheet P. FIG. 23(*b*) is a plan view showing the arrangement of staple units 30A and 30B by which 2 portions are stapled. The staple units 30A and 30B are diagonally arranged at the home position which is equal distance $A_0$ from the center line CL of the sheet P, (the position shown by dashed line in the drawing), and when 2 portion stapling is designated, the staple units are rotated by a driving means, which will be described later, and arranged at positions parallel with the center line CL of the sheet P. Staple pins ST are pinned in parallel on 2 portions of the sheet P by the staple units 30A and 30B arranged in parallel with the center line CL.

Figure 24:
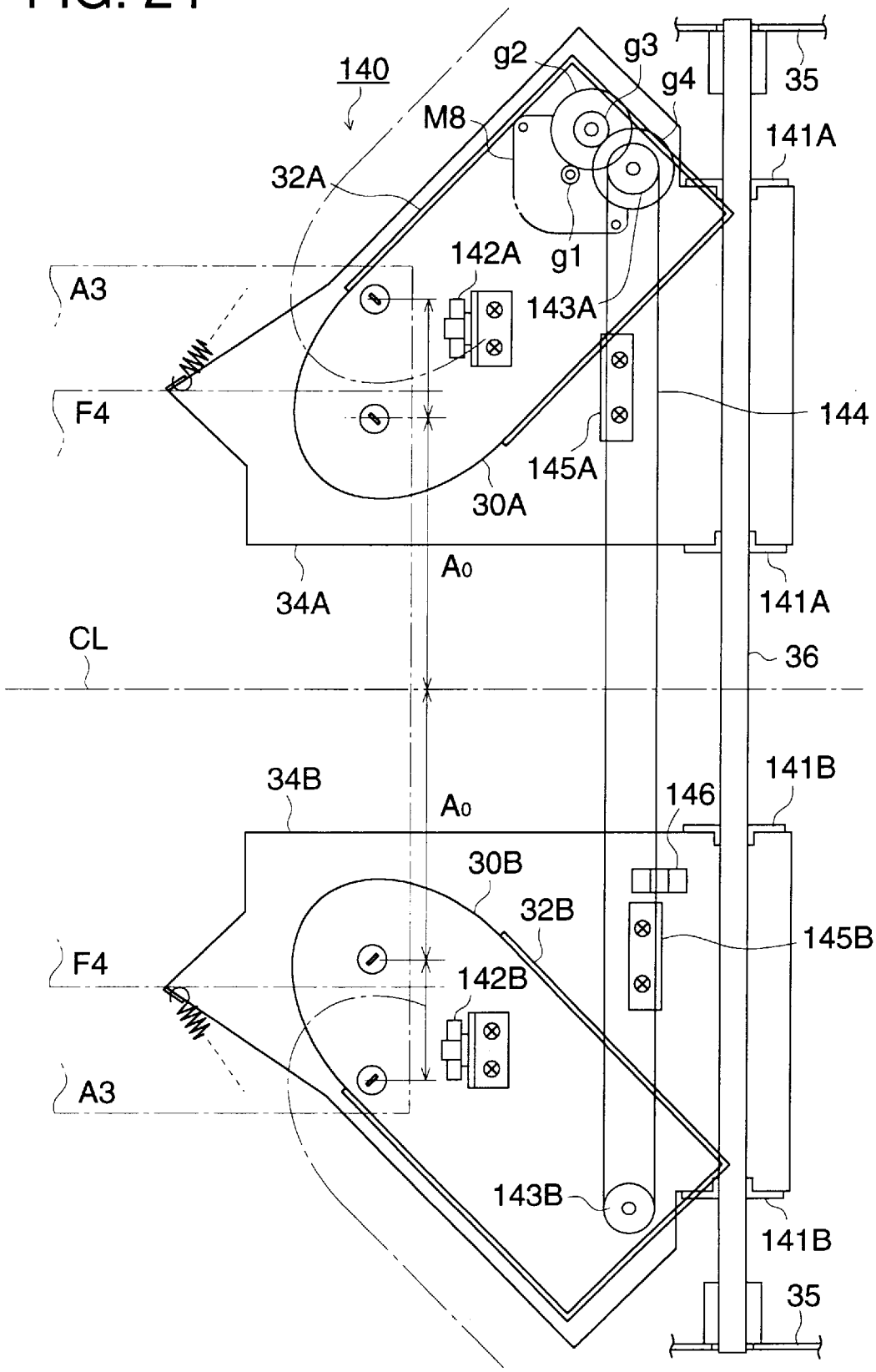
FIG. 24 is a plan view of a linear movement means of the staple means.

FIG. 24 is a plan view of a linear movement means 140 of the staple means. Two staple units 30A and 30B are symmetrically arranged at both sides of the center line CL. The supporting bases 32A and 32B to support the staple units 30A and 30B, are respectively arranged on the moving base plates 34A and 34B. Bearing members 141A and 141B, fixed to the moving base plates 34*a* and 34B, are supported by a rail shaft 36, arranged on the oscillation base plate 35, so that the bearing members 141A and 141B can slide on the rail shaft 36. Rollers 142A and 142B, supported by the bottom portion of the moving base plates 34A and 34B, are supported on the surface of the oscillation base plate 35 so as to be rotatable. The moving base plates 34A and 34B can linearly move on the oscillation base plate 35. The motor (stepping motor) M8, mounted on the oscillation base plate 35, rotates a driving pulley 143A through gears g1, g2, g3, and g4, and rotates a belt 144 stretched between the driving pulley 143A and a driven pulley 143B. The supporting bases 32A and 32B are held on 2 portions of the belt 144 by holding members 145A and 145B. The staple units 30A and 30B, respectively supported by the supporting bases 32A and 32B, are linearly moved on the oscillation base plate 35 by the rotation of the belt 144 by the drive of the motor M8. Incidentally, numeral 146 is a home position detection sensor to control home positions of the staple units 30A and 30B.

Figure 25:
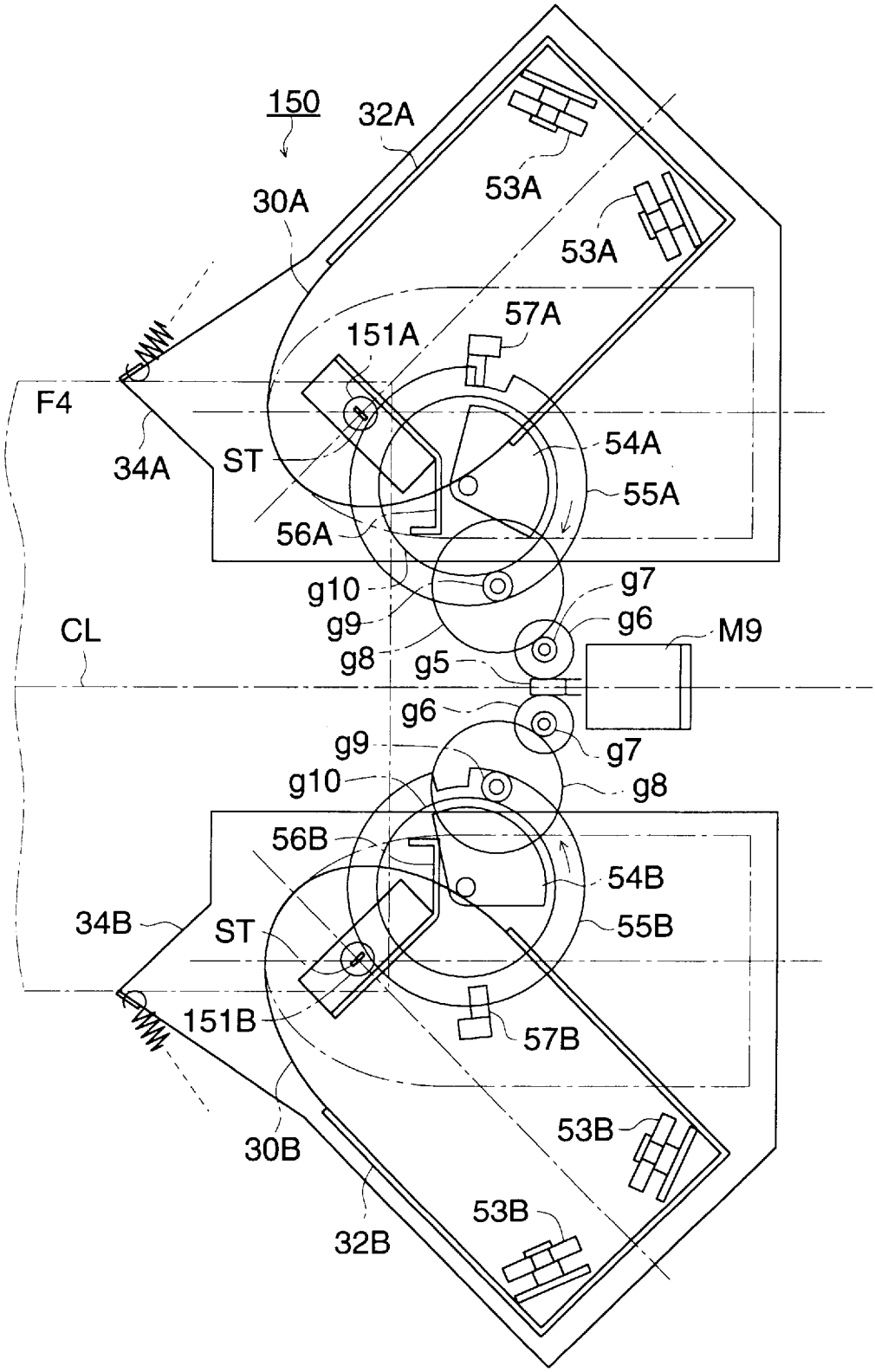
FIG. 25 is a plan view of a rotation means by which the staple means are rotated and arranged in parallel with each other.
Figure 26:
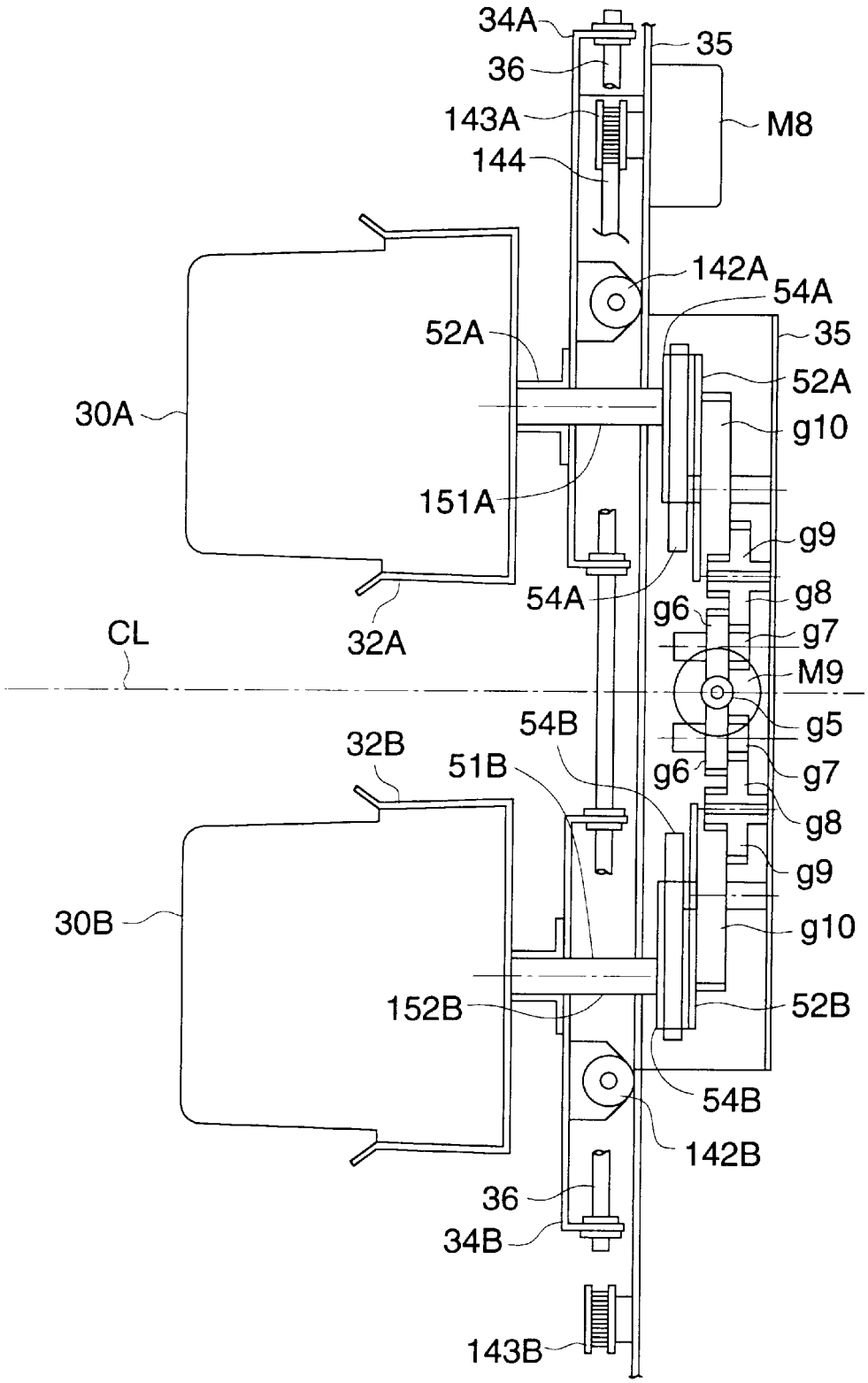
FIG. 26 is a rear view of the rotation means.

FIG. 25 is a plan view of a rotation means 150 to rotate the staple means 30 and to arrange it in parallel. FIG. 26 is a rear view of the rotation means 150. Two staple units 30A and 30B are diagonally arranged by 45° at the left and right portions, symmetrically with respect to the center line CL. The supporting base 32A to support the far side staple unit 30A is arranged on the moving base plate 34A. A rotational fulcrum shaft 151A is fixed on the supporting base 32A below the central portion of the pinning position of the staple pin ST of the staple unit 30A. The supporting base 32A is supported such that it can be oscillated, by a bearing 52A which rotatably supports the rotational fulcrum shaft 151A, and a roller 53A which can roll on the surface of oscillation base plate 35. In the same manner, the supporting base 32B which supports the near side staple unit 30B, is arranged on the moving base plate 34B. A rotational fulcrum shaft 151B is fixed on the supporting base 32B, below the central portion of the pinning position of the staple pin ST of the staple unit 30B. The supporting base 32B is supported such that it can be oscillated, by a bearing 52B which rotatably supports the rotational fulcrum shaft 151B, and a roller 53B which can roll on the surface of oscillation base plate 35.

A staple unit driving motor M9, arranged at the bottom center of the oscillation base plate 35, rotates staple unit driving cams 54A, 54B and home position detection cams 55A and 55B, which are fixed coaxially with a gear 10, through a gear 5 and a gear train of pairs of left and right gears g6, g7, g8, g9, and g10. Cam levers 56A and 56B are integrally fixed on the rotational fulcrum shafts 151A and 151B. In this connection, numerals 57A and 57B are home position detection sensors which control rotational home positions of the staple units 30A and 30B, and which detect cutout portions of the home position detection cams 55A and 55B, and control the home positions.

Cams 54A and 54B are driven by the motor M9 through the gear train of pairs of the left and right gears. By the rotation of the cams 54A and 54B, cam levers 56A and 56B are rotated, the staple units 30A and 30B are simultaneously rotated around the rotational fulcrum shafts 151A and 151B, and move from the home positions, diagonally arranged by 45°, to parallel positions shown by one-dotted chain lines in the drawing. By the staple units 30A and 30B, which have been rotated and moved to these parallel positions, 2 staple pins ST are pinned, in parallel, on 2 portions at the center near the trailing end portion of the sheet P as shown in FIGS. 23(*a*) and 23(*b*).

Figure 27:
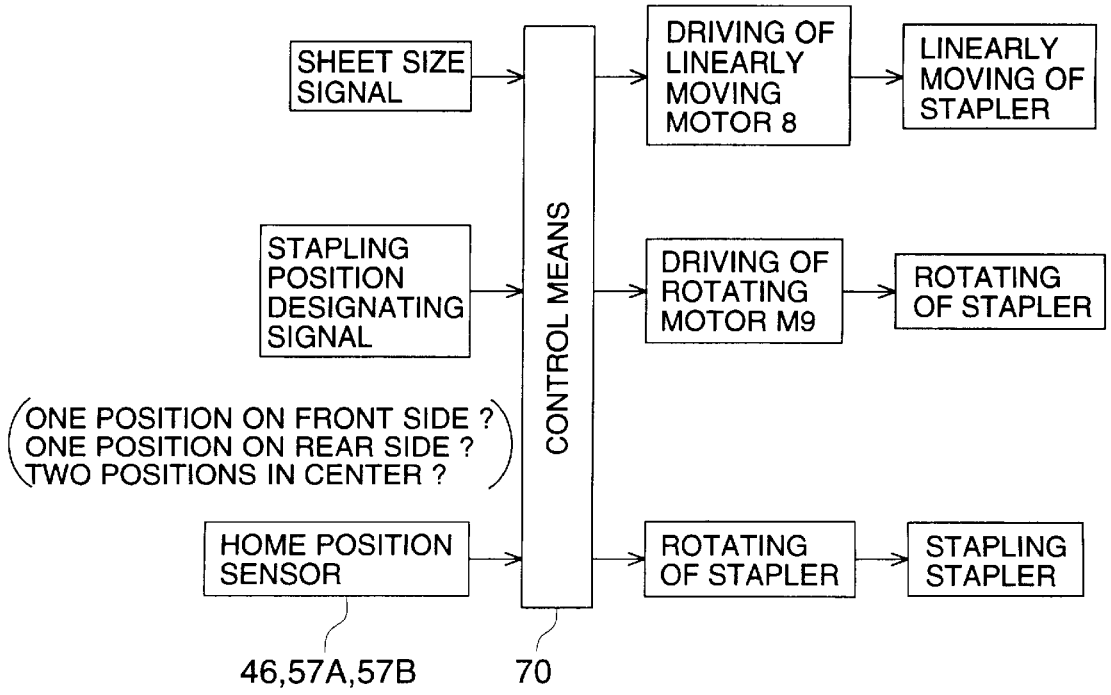
FIG. 27 is a block diagram showing the control of the staple means.
Figure 28:
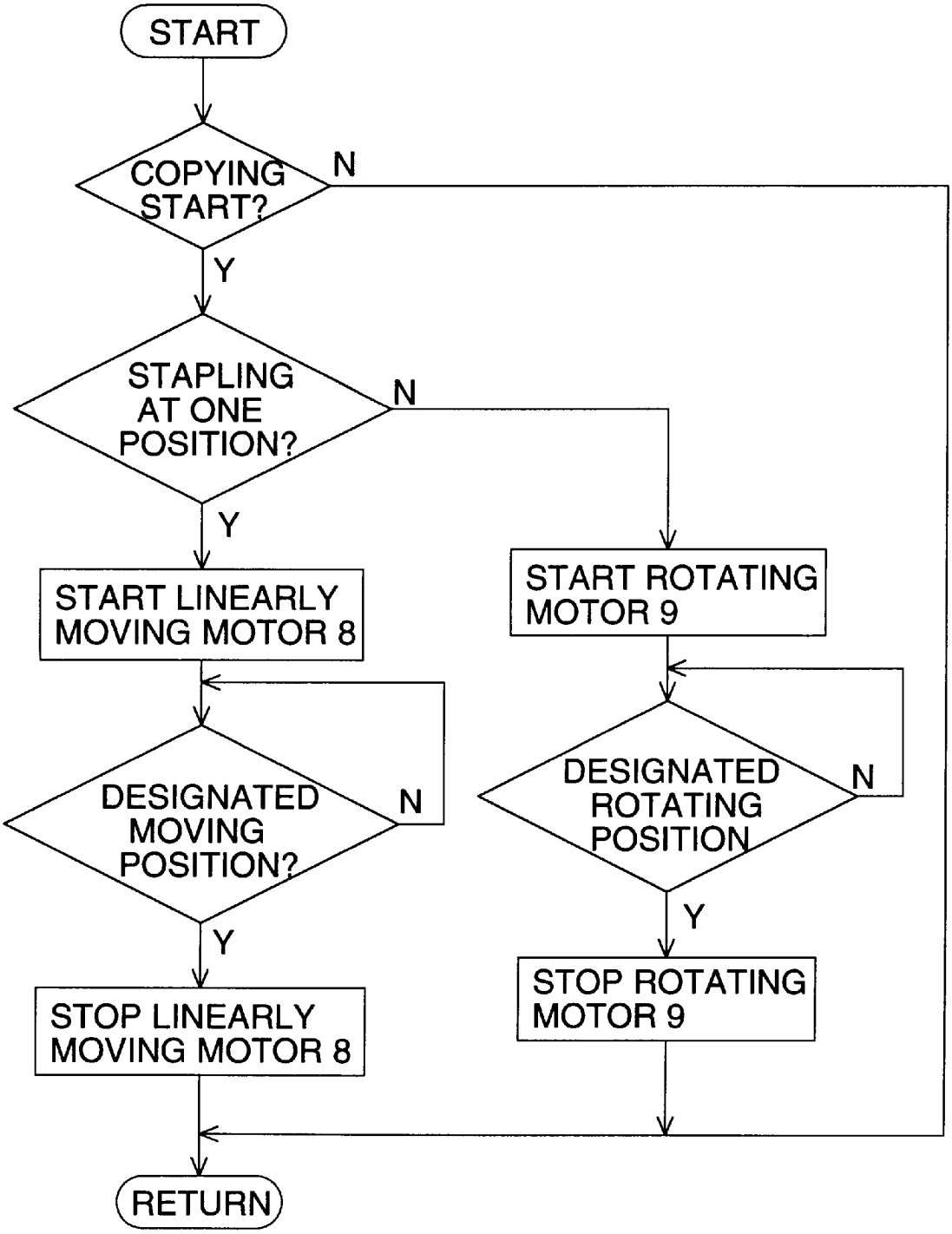
FIG. 28 is a flow chart showing a movement process of the staple means.

FIG. 27 is a block diagram showing the control of the staple means. FIG. 28 is a flow chart showing operation processes of the staple means. According to a sheet size signal and a staple position designation signal, sent from the image forming apparatus connected to the sheet finisher, a control means 70 drives the motor M8 so that the staple units 30A and 30B are linearly moved from the home position, and the staple pin ST is pinned on a portion in one corner of a sheet of a designated size. Alternatively, the control means 70 drives the motor M9 so that the staple units 30A and 30B are rotated and moved from the home position, and the staple pins ST are stapled on two portions, which are symmetrical with the center line of the sheet.

In the sheet finisher described above, a double-side reference system is adopted in which the sheet P, delivered from the image forming apparatus, is used depending on the center line CL as a reference, and a set of two movable alignment members can be moved in the direction of sheet width. However, the present invention can also be applied to a single side reference system, composed of a fixed alignment plate and movable alignment plate.

As described above, due to the sheet finisher of the present invention, when failures such as buckling of the staple pin occur during stapling of a set of sheets, failed set of sheets or staple pin can be easily and quickly taken out.

Further, in the first staple mode in which one portion is stapled, the staple unit is arranged diagonally (for example, 45°) with respect to the width of the sheet, is linearly moved to the staple position of a predetermined distance from a corner of the sheet corresponding to the sheet size, and a staple pin is diagonally stapled at one portion. Thereby, when a customer opens pages of the stapled set of sheets, there is no possibility that a sheet is broken at the portion of the staple pin. Further, in the second staple mode in which staple pins are pinned on 2 portions near the center of the sheet width for binding the sheets, the staple unit is rotated so that 2 staple pins are stapled on 2 positions parallel to the direction of the sheet width.

The above first mode and second mode are quickly conducted by the linear movement means, rotation means, and control means.

What is claimed is:

1. A sheet finishing apparatus comprising:

(a) a first conveying means for receiving and holding a recorded sheet discharged from a discharging section of an image forming apparatus and for conveying the recorded sheet along a sheet conveyance path;

(b) a second conveying means at a predetermined distance from the first conveying means, said distance being less than a length, in the sheet conveying direction, of a minimum size of sheet to be conveyed, whereby the recorded sheet conveyed by said first conveying means is conveyed by said second conveying means;

(c) a shifting means, which does not convey the recorded sheet in an ejecting direction, between the first and second conveying means for substantially shifting sets of a predetermined number of recorded sheets, set by set, in each of a plurality of shifting positions of a direction perpendicular to the conveying direction of the recorded sheet; and (d) a delivery sheet tray for receiving the recorded sheet delivered by the second conveying means.

2. The sheet finishing apparatus of claim 1 further comprising:

a first activating means for activating either the first or second conveying means so that a pressure contact is released;

a second activating means for activating the shifting means so that both holding and shifting operations are carried out;

a sheet path sensor for detecting the recorded sheet passing through the sheet conveyance path; and a control means for controlling the first and second activating means according to a signal outputted from the sheet path sensor.

3. The sheet finishing apparatus of claim 2 wherein the control means is adapted to control the first and second activating means so that at least one of the first and second conveying means releases the pressure contact when the recorded sheet reaches the shifting means, the shifting means is adapted to thereafter shift the recorded sheet, at least one of the first and second conveying means coming into contact with the recorded sheet and conveying the recorded sheet according to the signal outputted from the sheet path sensor.

4. The sheet finishing apparatus of claim 1, wherein the shifting means includes an upper side holding member and a lower side holding member for holding the recorded sheet, in which a portion contacting the recorded sheet of at least one of the upper side and lower side holding members is oscillatably supported.

5. The sheet finishing apparatus of claim 1, wherein the second conveying means is provided in a vicinity of a sheet exit port on a downstream side of the first conveying means with respect to the sheet conveyance direction, and ejects the recorded sheet to the delivery sheet tray.

6. The sheet finishing apparatus of claim 1 wherein the shifting means is adapted to hold the recorded sheet so that the recorded sheet is unable to slide when the shifting means holds the recorded sheet.

7. A sheet finishing apparatus comprising:

(a) a conveying means for receiving and holding a recorded sheet discharged from a discharging section of an image forming apparatus and for conveying along a sheet conveyance path; and (b) a low speed ejecting means provided in a vicinity of a sheet exit port on a downstream side of the conveying means with respect to a sheet conveyance direction for ejecting the recorded sheet to a delivery sheet tray at a sheet conveyance speed less than that of the conveying means, wherein the low speed ejecting means shifts sets of a prescribed number of recorded sheets, set by set, in a direction perpendicular to a conveying direction of the recorded sheet while an ejecting operation is carried out, thereby the sheets are delivered to the delivery sheet tray while being shifted.

8. The sheet finishing apparatus of claim 1 further comprising:

an intermediate stacker for stacking the recorded sheet;

an aligning means for aligning the sheets; and a stapling means for stapling an edge of the aligned sheets;

the stapling means comprising, a supporting table for supporting the stapling means, an oscillating means for oscillatably supporting the supporting table with respect to the intermediate stacker, and an engaging means for disengageably engaging with the oscillating means, wherein the engaging means releases the oscillating means thereby the supporting table is oscillated by the oscillating means, and a stacking portion at an edge of the sheets stacked on the stacker can be opened so as to be accessible.

9. The sheet finishing apparatus of claim 8, wherein the supporting table detachably supports the stapling means, and after an engagement of the engaging means is released and the supporting table is oscillated by the oscillating means, the stapling means can be detachably attached to the stapling means.

10. The sheet finishing apparatus of claim 1 further comprising:

an intermediate stacker for stacking the recorded sheets;

a stopper for colliding with an edge of the sheets stacked on the intermediate stacker;

an aligning means for aligning the sheets; and a stapling means for stapling an edge of the aligned sheets;

the stapling means comprising, a moving plate for supporting the stapling means and being movable in a direction parallel to a stopping surface of the stopper, a linear moving means for moving the moving plate in the direction parallel to the stopper surface, a rotating means for rotating the staple means by a prescribed angle with respect to the stopper surface, and a control means for controlling the linear moving means and the rotating means so that the stapling means can be moved in a selected position and angle.

11. The sheet finishing apparatus of claim 10, wherein a home position of the moving plate loaded with the stapling means is a vicinity of a center of a width direction of the edge of the sheet, and a home position of the stapling means loaded on the moving plate is a position inclined by a predetermined angle with respect to a sheet width direction.

12. The sheet finishing apparatus of claim 10, wherein when the stapling means staples one end of the sheet ends, the linear moving means moves linearly the moving plate from the home position to said one end.

13. The sheet finishing apparatus of claim 10, wherein the stapling means staples in a vicinity of a center in a width direction of the sheet end, the moving plate is at the home position, the stapling means is in a position perpendicular to the stopper surface.

14. The sheet finishing apparatus of claim 8, in a one-position stapling mode, one staple is stapled at a corner of the sheets in a oblique direction to the end of the sheets, while in a two-position stapling mode, two staples are stapled at positions of the end of the sheets in parallel to a direction of a width of the sheets.

* * * * *